US007398970B2

(12) United States Patent
Morimoto et al.

(10) Patent No.: US 7,398,970 B2
(45) Date of Patent: Jul. 15, 2008

(54) ORIGINAL TRANSPORT APPARATUS

(75) Inventors: Yasumasa Morimoto, Kashihara (JP); Masato Tamehira, Nara (JP); Yoshinori Shiraishi, Tenri (JP); Masatsugu Ohishi, Nara (JP); Yoshiyuki Nishizato, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/782,729

(22) Filed: Feb. 18, 2004

(65) Prior Publication Data

US 2004/0188918 A1 Sep. 30, 2004

(30) Foreign Application Priority Data

Feb. 19, 2003 (JP) ..... 2003-041395

(51) Int. Cl.
*B65H 3/06* (2006.01)

(52) U.S. Cl. ..... 271/117; 271/118

(58) Field of Classification Search ..... 271/117, 271/118, 121, 109

See application file for complete search history.

(56) References Cited

U.S. PATENT DOCUMENTS

| | | | | |
|---|---|---|---|---|
| 5,470,052 | A * | 11/1995 | Asakawa et al. | 271/118 |
| 6,431,541 | B2 * | 8/2002 | Kuo et al. | 271/118 |
| 6,651,971 | B2 * | 11/2003 | Tsuei | 271/109 |
| 6,651,972 | B2 * | 11/2003 | Hsiao et al. | 271/114 |
| 6,792,241 | B2 * | 9/2004 | Nakagawa et al. | 399/367 |
| 6,991,227 | B2 * | 1/2006 | Kim | 271/10.12 |
| 2002/0033572 | A1 * | 3/2002 | Takisawa et al. | 271/109 |
| 2002/0074711 | A1 * | 6/2002 | Higaki | 271/117 |
| 2002/0096819 | A1 * | 7/2002 | Fukasawa et al. | 271/121 |

FOREIGN PATENT DOCUMENTS

| | | | |
|---|---|---|---|
| CN | 1359841 | | 7/2002 |
| JP | 60-122643 | * | 7/1985 |
| JP | 1-281234 | * | 11/1989 |
| JP | 2001199584 | | 7/2001 |
| JP | 2001341879 | | 12/2001 |

* cited by examiner

*Primary Examiner*—Patrick Mackey
*Assistant Examiner*—Thomas A Morrison
(74) *Attorney, Agent, or Firm*—George W. Neuner; David G. Conlin; Edwards Angell Palmer & Dodge LLP

(57) ABSTRACT

In the context of a structure wherein outer casing(s) is/are disposed so as to permit opening and closing about shaft(s), stopper member(s) and engagement piece(s) engaging with such stopper member(s) being disposed at such outer casing(s) so as to permit independent displacement in pivoting fashion about shaft(s) for each thereof, one end(s) of arm member(s) is/are supported by outer casing(s) so as to permit displacement in pivoting fashion, and shaft(s) of stopper member(s) is/are secured to other end(s) of such arm member(s). In addition, when bottom region(s) of stopper member(s) in engaged state(s) with engagement piece(s) abuts or abut and is/are pressed upward by original(s) loaded in original tray(s) during closing of outer casing(s) which had at least immediately prior thereto been in open state(s), this causes other end(s) of arm member(s) to be displaced upward in pivoting fashion, in accompaniment to which stopper member(s) is/are lifted upward.

10 Claims, 25 Drawing Sheets

-Prior Art-

-Prior Art-

-Prior Art-

-Prior Art-

-Prior Art-

ORIGINAL TRANSPORT APPARATUS

BACKGROUND OF INVENTION

This Nonprovisional application claims priority under 35 U.S.C. §119(a) on patent Application No.2003-041395 filed in Japan on Feb. 19, 2003, the entire contents of which are hereby incorporated by reference.

The present invention pertains to an original transport apparatus for taking up one or more original sheets one sheet at a time and transporting same during image capture.

Conventionally known techniques for capturing images of originals include two capturing methods, these being stationary-original capture and moving-original capture.

Because the stationary-original capture method is such that capture takes place with the original being held stationary and with scanning being accomplished through movement of the image information capture component (optical unit), this is suitable where the original is a book or is card stock. There is also the advantage that because scanning is performed by an image information capture component (optical unit), the precision with which capture takes place can easily be increased.

In contrast thereto, because the moving-original capture method is such that capture takes place with the image information capture component (optical unit) being held stationary and with scanning being accomplished through movement of the original, this has the advantage that the apparatus can be reduced in size, and also that the area occupied by the apparatus can be made small; e.g., when the apparatus is employed in an image forming apparatus. Furthermore, if a number of originals are placed together in the original tray, there is the significant advantage that because capture takes place automatically with these being taken up one sheet at a time, a large quantity of originals can be captured in a short period of time with little inconvenience to the operator.

Furthermore, with the moving-original capture method, whereas the number of original sheets that could be placed in the original tray at a single time was previously on the order of 20 to 40 sheets, it has in recent years become possible to place somewhere in the neighborhood of 100 sheets therein. This has been made possible due in part to improved printing speed, increased memory capacity of the controller provided within the capturing apparatus which temporarily stores image data, improved controller processing speed, and so forth.

However, where the number of original sheets placed therein increases as has been stated to be the case, the likelihood that any given set of stacked originals (one job) can be transported and captured without incident decreases. Furthermore, where an original capturing apparatus is used in combination with an image forming apparatus as a copier, occurrence of a problem at the image forming apparatus will also cause operations at the original capturing apparatus to be temporarily stopped. In the event that an original becomes stuck in this way somewhere along the original transport path, it will be necessary to remove that original.

Now, there are arrangements in which a stopper member for stopping original lead edges and blocking off the near side of the transport path is arranged at an original tray so as to align lead edges and prevent skewing of originals loaded in an inclined original tray while withstanding the weight of such originals during the period prior to initiation of transport of the first original from the original tray, while also preventing situations such as those in which originals accidentally enter the transport path and cause multiple sheets to be transported in conjunction with initiation of transport (see, e.g., Japanese Patent Application Publication Kokai No. 2001-199584).

With an original tray such as is described in such places as this Japanese Patent Application Publication Kokai No. 2001-199584, in the event that an original becomes stuck somewhere along the original transport path, it will as has been described above be necessary to remove that original therefrom, but because it has not conventionally been possible to open and close the outer casing thereof, retrieval of originals therefrom has been troublesome. Accordingly, there has been a need to implement operations such as would permit opening and closing of the outer casing so as to facilitate retrieval of originals which have become stuck therein.

But in constitutions in which a stopper member such as is described in the aforementioned Japanese Patent Application Publication Kokai No. 2001-199584 is, for example, provided at the outer casing, implementation of operations for opening and closing the outer casing can sometimes result in situations in which opening of the outer casing causes originals to slide down the original tray under the force of their own weight and to be displaced from original loading location(s), resulting in alteration of the timing with which originals are taken up thereinto and so forth. Furthermore, when an attempt is made to close the outer casing, a new problem can occur in which the stopper member comes in contact with the leading edges of originals sliding down thereonto, piercing and damaging originals in a worst-case scenario.

The situation will be described in detail with reference to the original transport apparatus of constitution as shown in FIGS. 21 through 25. Note that FIGS. 21 through 24 are vertical sectional views of the original transport apparatus, and FIG. 25 is a schematic plan view thereof.

Outer casing 1, which houses pickup roller R1 and separation roller R2, is such that the basal side thereof (the right side in the drawing) is supported by shaft 2, disposed in a direction perpendicular to the original transport direction, so as to permit opening and closing about a horizontal axis; shaft 2 disposed in a direction perpendicular to transport direction X of original 11 serving as center of rotation during opening and closing. Furthermore, at the free side (the left side in the drawing) of outer casing 1, stopper member 4 is supported by shaft 3, disposed in a direction perpendicular to transport direction X, so as to permit displacement in pivoting fashion.

Furthermore, in the region of an edge at the basal side of outer casing 1, separation roller R2 is rotatably supported by support pin 5, which is disposed in a direction perpendicular to transport direction X; one end of pickup arm 6 being supported by this support pin 5 so as to permit displacement in pivoting fashion. Furthermore, at the other end of pickup arm 6, pickup roller R1 is rotatably supported by support pin 7, which is disposed in a direction perpendicular to transport direction X.

Moreover, post 8 is provided at outer casing 1, engagement piece 9 being supported by this post 8 by means of support pin 9*c* so as to permit displacement in pivoting fashion. Furthermore, engagement finger 9*a*, provided in the region at one end of this engagement piece 9, engages with engagement finger 4*a* provided in the region of the top end of stopper member 4, causing stopper member 4 to be retained such that it is roughly vertical. As a result, stopper member 4, as has been described, blocks the near side of transport path 12 so as to align lead edges 11*a* of originals 11 loaded in original tray 10 while withstanding the weight of such originals 11, and also prevents originals 11 from accidentally entering transport path 12.

Moreover, protruding horizontally from the region at the other end of engagement piece 9 is thrust pin 9*b*, this thrust pin 9*b* being pushed on and driven by thrust piece 6*b*, which is provided in the region at one end of pickup arm 6.

At this engagement piece 9, the weight to the engagement finger 9*a* side of support pin 9*c* is greater than the weight to the thrust pin 9*b* side thereof. Accordingly, when thrust piece 6*b* is not in contact with thrust pin 9*b*, i.e., when pickup arm 6 is in its raised position (the situation shown in FIG. 21), the aforementioned weight distribution causes the engagement finger 9*a* side thereof to be displaced downward in pivoting fashion, so that engagement finger 9*a* engages with engagement finger 4*a* of stopper member 4 as described above.

FIG. 25 is a schematic plan view of an original transport apparatus constituted as described above.

Disposed more or less centrally in the width direction of outer casing 1 of this original transport apparatus is pickup arm 6 possessing pickup roller R1 and separation roller R2; furthermore, stopper members 4 and engagement pieces 9, constituted as described above, are respectively arranged at locations outward from, and to either side in the width direction of, this pickup arm 6. That is, stopper members 4 and engagement pieces 9 are disposed at locations outward from pickup arm 6 such that a pair of each respectively straddles pickup arm 6.

Furthermore, provided at one side of pickup arm 6 is drive control means which drives pickup arm 6 so as to displace it in pivoting fashion, this drive control means being primarily made up of electromagnetic clutch 81, torque limiter 82, and pickup arm spring 83. That is, engagement and disengagement of drive is carried out by electromagnetic clutch 81, pickup arm 6 being driven in pivoting fashion by virtue of the force at torque limiter 82. Furthermore, the restoring force from pickup arm spring 83 is always acting on pickup arm 6 in a direction tending to raise it upward, so that, at times when there is no force acting at torque limiter 82, the restoring force from this pickup arm spring 83 causes pickup arm 6 to be raised and assume a prescribed position within outer casing 1.

FIG. 21 shows the situation described above which exists when engagement finger 4*a* of stopper member 4 is engaged with engagement finger 9*a* of engagement piece 9, and the near side of transport path 12 is blocked off.

When capture of originals is initiated with the apparatus in this state, the aforementioned drive control means, as shown in FIG. 22, causes pickup arm 6 to pivot as indicated by the arrow at reference numeral 91, and pickup roller R1 comes in contact with the topmost sheet(s) among originals 11, taking up the topmost original sheet. Furthermore, pivoting displacement of this pickup arm 6 causes thrust piece 6*b* to press down on and lower thrust pin 9*b*, causing the engagement finger 9*a* side of engagement piece 9 to rise up as indicated by the arrow at reference numeral 92, and causing the two engagement fingers 9*a*, 4*a* which had been mutually engaged to become disengaged. Accordingly, as the taking up of topmost original sheet(s) 11*a* proceeds, the lead edge(s) of such original(s) 11*a* cause stopper member 4 to be lifted up as indicated by the arrow at reference numeral 93, opening up access to transport path 12, whereupon separation roller R2 and separation plate 16 cause only a single sheet to be selectively extracted from original(s) 11*a*, and this is then guided toward an original capturing unit, not shown.

With a constitution such as has been described, when outer casing 1 is opened due to occurrence of a transport problem as shown in FIG. 23, originals 11 slide down original tray 10 under the force of their own weight and are displaced from original loading location(s). Furthermore, when outer casing 1 is opened, engagement finger 4*a* of stopper member 4, which is raised up thereto in accompaniment to movement of outer casing 1, engages with engagement finger 9*a* of engagement piece 9, engagement piece 9 having been in its freed orientation.

With the apparatus in this state, closing outer casing 1 as indicated by the arrow at reference numeral 94 causes the problematic situation shown in FIG. 24 in which the bottom region of stopper member 4 abuts originals 11 during closing of that outer casing 1 and forces its way past originals 11.

The present invention was conceived in order to solve such problems, it being an object thereof to provide an original transport apparatus capable of mitigating problems associated with stopper member(s) occurring in conjunction with opening and/or closing of outer casing(s) without interfering with intended function of stopper member(s) (ability to constrain original lead edge(s) when original(s) is/are loaded).

SUMMARY OF INVENTION

An original transport apparatus in accordance with one or more embodiments of the present invention automatically takes up one or more originals one sheet at a time from where it or they is or are loaded in one or more original trays and transports same toward one or more transport paths, the original transport apparatus being such that one or more outer casing members is or are arranged at one or more locations above one or more lower tip regions of at least one of the original tray or trays which is arranged so as to be inclined downward; at least one of the outer casing member or members is disposed so as to permit opening and closing about one or more shafts arranged in one or more directions perpendicular to one or more directions of transport of at least one of the original or originals; one or more stopper members and one or more engagement pieces are disposed at at least one of the outer casing member or members so as to permit respectively independent displacement in pivoting fashion about one or more shafts arranged in one or more directions perpendicular to at least one of the original transport direction or directions; at least one of the stopper member or members causes at least one lead edge of at least one of the original or originals loaded in at least one of the original tray or trays to stop at at least one prescribed location; at least one of the engagement piece or pieces engages with at least one of the stopper member or members; when at least one of the outer casing member or members is in at least one closed state and the apparatus is in at least one original takeup standby state, engagement of at least one of the stopper member or members by at least one of the engagement piece or pieces causes the at least one stopper member to be retained in a state in which the at least one stopper member stops at least one of the lead edge or edges of at least one of the original or originals at at least one of the prescribed location or locations, constraining at least one location of at least one of the lead edge or edges of at least one of the original or originals and preventing entry of at least one of the original or originals into at least one of the transport path or paths; and when at least one of the outer casing member or members is in at least one of the closed state or states and takeup of at least one of the original or originals is proceeding, at least one of the engagement piece or pieces is displaced in pivoting fashion, disengaging engagement between the at least one engagement piece and at least one of the stopper member or members, permitting pivoting displacement of the at least one stopper member and allowing transport of at least one of the original or originals.

Here, one end of arm member(s) may be supported by outer casing member(s) so as to permit displacement in pivoting fashion; and shaft(s) of stopper member(s) may be secured to other end(s) of such arm member(s). As a result of adoption of such a constitution, when, during the course of closing outer casing member(s) which had at least immediately prior thereto been in open state(s), bottom region(s) of stopper member(s) in engaged state(s) with engagement piece(s) abuts or abut and is/are pressed upward by original(s) loaded in original tray(s), this causes other end(s) of arm member(s) to be displaced upward in pivoting fashion, in accompaniment to which stopper member(s) move upward in such fashion as to cause it or them to be contained within outer casing member(s).

That is, abutting of original(s) by bottom region(s) of stopper member(s) when attempting to close outer casing member(s) causes arm member(s) to be displaced upward in pivoting fashion, and causes stopper member(s) to be lifted up, as is/are engagement piece(s) which is/are lifted up together therewith. At such time, because stopper member(s) is/are located between pivot axis or axes of such engagement piece(s) and such arm member(s), stopper member(s) and engagement piece(s) separate from each other as stopper member(s) rise, disengaging engagement that had existed between stopper member(s) and engagement piece(s). This makes it possible to mitigate interference by stopper member(s) with respect to original(s) and makes it possible to prevent damage to original(s).

Furthermore, lifting piece(s) for lifting engagement piece(s) upward may be integrally provided at arm member(s); and when, during the course of closing outer casing member(s) which had at least immediately prior thereto been in open state(s), bottom region(s) of stopper member(s) in engaged state(s) with engagement piece(s) abuts or abut and is/are pressed upward by original(s) loaded in original tray(s), this may cause other end(s) of arm member(s) to be displaced upward in pivoting fashion, in accompaniment to which stopper member(s) move upward, and lifting piece(s) move upward so as to further lift upward engagement piece(s) and disengage engagement between stopper member(s) and engagement piece(s). By thus providing lifting piece(s), it is possible to more definitively disengage engagement between stopper member(s) and engagement piece(s).

Furthermore, outer casing member(s) may be provided with guide component(s) causing stopper member(s) to be displaced in pivoting fashion such that it/they is/are raised upward when arm member(s) is/are displaced in pivoting fashion such that it/they subtends or subtend not less than preestablished angle(s). More specifically, guide component(s) may be formed as guide surface(s) formed at top inside wall region(s) of outer casing member(s). That is, top region(s) of stopper member(s) that has or have moved upward may abut guide surface(s) and slide therealong so as to cause stopper member(s) to be displaced in pivoting fashion such that it/they is/are raised upward.

This being the case, during closing of outer casing member(s), even where engagement between stopper member(s) and engagement piece(s) has been disengaged, stopper member(s), as a result of being pressed into outer casing member(s), will rise further as top region(s) thereof is/are guided by guide surface(s). Accordingly, damage to original(s) and/or stopper member(s) can be definitively prevented even where operations for opening and/or closing outer casing member(s) are carried out while original(s) is/are loaded.

Furthermore, an original transport apparatus in accordance with one or more embodiments of the present invention automatically takes up one or more originals one sheet at a time from where it or they is or are loaded in one or more original trays and transports same toward one or more transport paths, the original transport apparatus being such that one or more outer casing members is or are arranged at one or more locations above one or more lower tip regions of at least one of the original tray or trays which is arranged so as to be inclined downward; at least one of the outer casing member or members is disposed so as to permit opening and closing about one or more shafts arranged in one or more directions perpendicular to one or more directions of transport of at least one of the original or originals; one or more stopper members and one or more engagement pieces are disposed at at least one of the outer casing member or members so as to permit respectively independent displacement in pivoting fashion about one or more shafts arranged in one or more directions perpendicular to at least one of the original transport direction or directions; at least one of the stopper member or members causes at least one lead edge of at least one of the original or originals loaded in at least one of the original tray or trays to stop at at least one prescribed location; at least one of the engagement piece or pieces engages with at least one of the stopper member or members; one or more pickup arms is or are disposed at at least one of the outer casing member or members so as to permit displacement in pivoting fashion about one or more shafts arranged in one or more directions perpendicular to at least one of the original transport direction or directions; at least one of the pickup arm or arms has at least one pickup roller for taking up at least one of the one or more originals one sheet at a time from where it or they is or are loaded in at least one of the original tray or trays; when at least one of the outer casing member or members is in at least one closed state and the apparatus is in at least one original takeup standby state, the fact that at least one of the pickup roller or rollers is positioned in at least one upper region within at least one of the outer casing member or members causes engagement between at least one of the stopper member or members and at least one of the engagement piece or pieces to be retained, constraining at least one location of at least one of the lead edge or edges of at least one of the original or originals and preventing entry of at least one of the original or originals into at least one of the transport path or paths; and when at least one of the outer casing member or members is in at least one of the closed state or states and takeup of at least one of the original or originals is proceeding, at least one of the pickup arm or arms is displaced downward in pivoting fashion so as to cause at least one of the pickup roller or rollers to move downward and away from at least one of the outer casing member or members so as to not be hidden thereby, and in linked fashion with respect to this pivoting displacement, at least one of the engagement piece or pieces is displaced in pivoting fashion, disengaging engagement between the at least one engagement piece and at least one of the stopper member or members, permitting pivoting displacement of the at least one stopper member and allowing transport of at least one of the original or originals.

Furthermore, pickup arm(s) may have first standby position(s), at which such pickup arm(s) and engagement piece(s) are not engaged, but at which engagement piece(s) and stopper member(s) are engaged; and second standby position(s), between first standby position(s) and position(s) occupied when takeup of original(s) is proceeding and pickup roller(s) has or have moved downward and away from outer casing member(s) so as to not be hidden thereby, at which pickup arm(s) and engagement piece(s) are engaged, but at which engagement piece(s) and stopper member(s) are disengaged; retaining member(s) being provided at outer casing member(s); and retaining member(s) retaining pickup arm(s) when second standby position(s) is/are occupied.

Here, retaining member(s) may comprise elastically deformable plate spring(s) provided at inside wall(s) of outer casing member(s); retaining member(s) abutting pivoting tip region(s) of pickup arm(s), retaining pickup arm(s), when pickup arm(s) is/are displaced in pivoting fashion at least as far as second standby position(s). Such an original transport apparatus may further comprise drive control means for driving pickup arm(s) so as to displace it/them in pivoting fashion; drive control means driving pickup arm(s) so as to cause it/them to be displaced in pivoting fashion from first standby position(s) to second standby position(s) when outer casing member(s) which had at least immediately prior thereto been in closed state(s) is/are opened.

That is, when outer casing member(s) is/are closed, stopper member(s) not being bound, bottom region(s) thereof abut original(s) and bottom region(s) of stopper member(s) thereafter slide over original surface(s); so that lifting thereof proceeds as outer casing member(s) is/are closed. This makes it possible to mitigate interference by stopper member(s) with respect to original(s) and makes it possible to prevent damage to original(s).

Furthermore, retaining member(s) may comprise pivot projection(s) provided at basal side(s), about which pivoting occurs, of pickup roller(s), and pivot constraining rod(s) provided at apparatus main body or bodies and constraining pivoting of pivot projection(s); pivot projection(s) abutting pivot constraining rod(s), retaining pickup arm(s), when pickup arm(s) is/are displaced in pivoting fashion at least as far as second standby position(s).

That is, when outer casing member(s) is/are closed, stopper member(s) not being bound, bottom region(s) thereof abut original(s) and bottom region(s) of stopper member(s) thereafter slide over original surface(s); so that lifting thereof takes place as closing proceeds. This makes it possible to mitigate interference by stopper member(s) with respect to original(s) and makes it possible to prevent damage to original(s). Furthermore, when outer casing member(s) is/are completely closed, because pickup arm constraint will have been eliminated, original(s) which have slipped beyond their proper location(s) may, with the apparatus in this state, be pulled back such their lead edge(s) are again in the proper location(s), at which time engagement finger(s) of engagement piece(s) will be able to surmount engagement finger(s) of stopper member(s) and become engaged therewith once again. This makes it possible for original(s) which have slipped beyond their proper location(s) to again be retained by stopper member(s) at position(s) where their lead edge(s) are in proper location(s).

DESCRIPTION OF PREFERRED EMBODIMENTS

Below, embodiments of the present invention are described with reference to the drawings.

Embodiment 1

Figure 1:
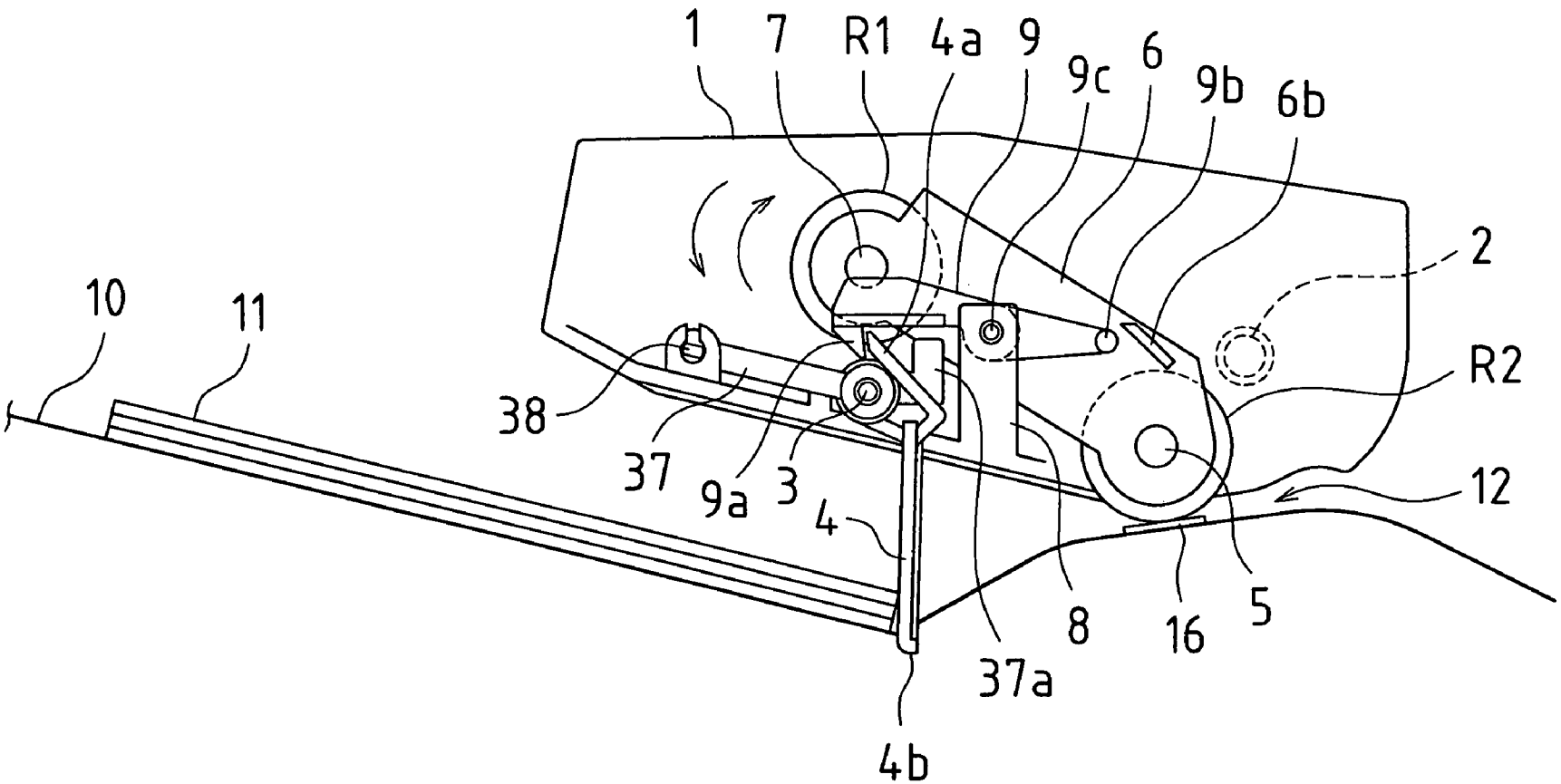
FIG. 1 is a vertical sectional view showing in schematic fashion the structure of an original transport apparatus associated with a first embodiment of the present invention.
Figure 2:
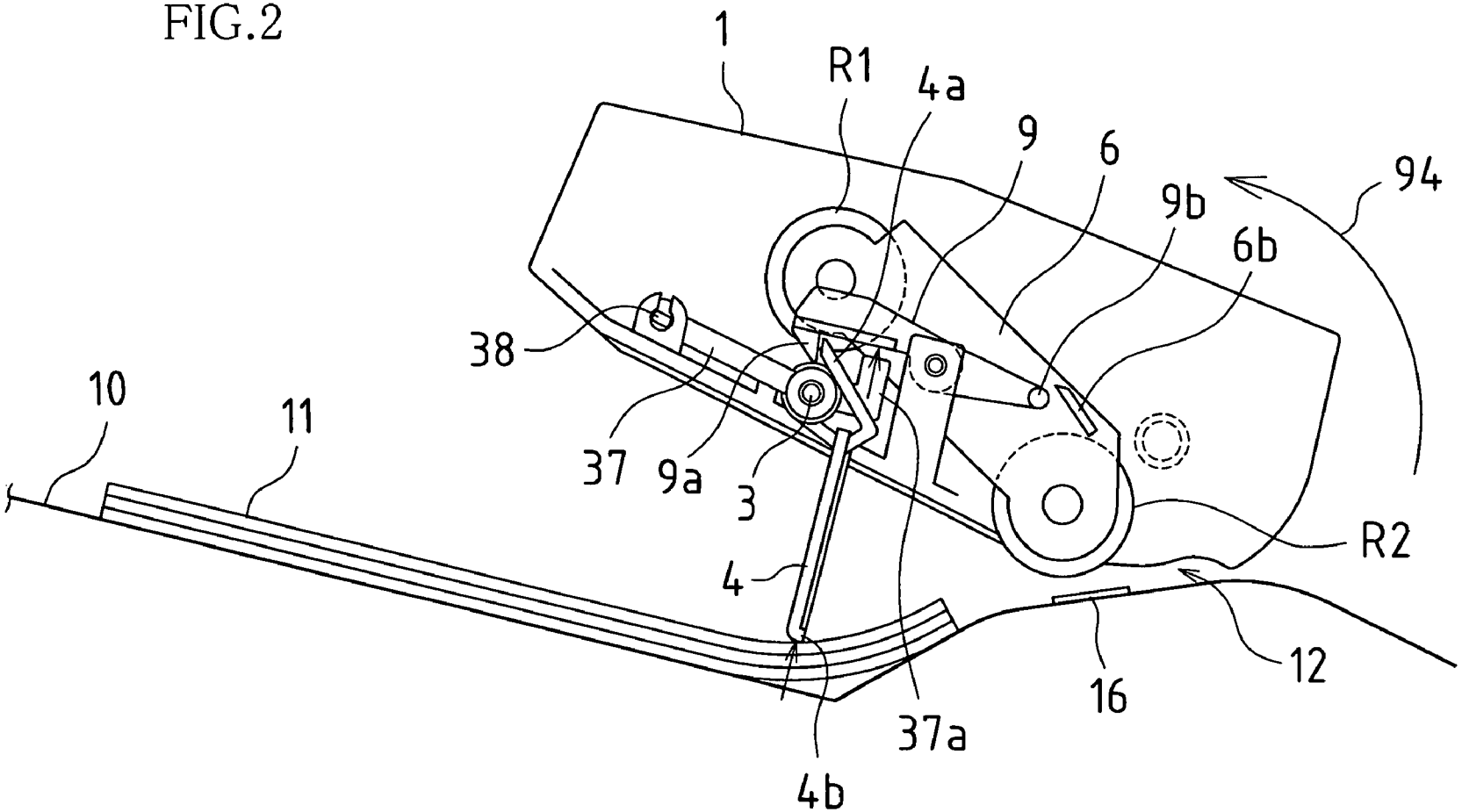
FIG. 2 is a vertical sectional view showing in schematic fashion the structure of an original transport apparatus associated with a first embodiment of the present invention.
Figure 3:
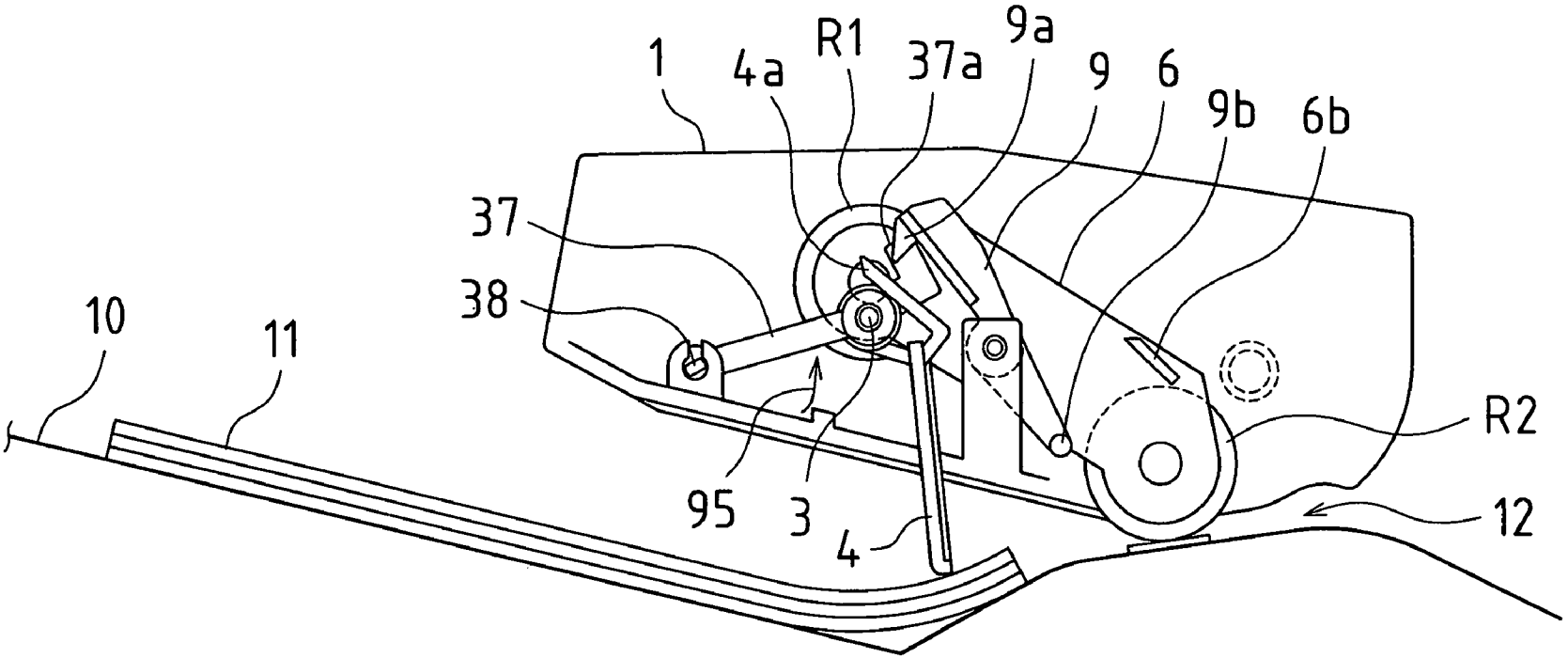
FIG. 3 is a vertical sectional view showing in schematic fashion the structure of an original transport apparatus associated with a first embodiment of the present invention.
Figure 4:
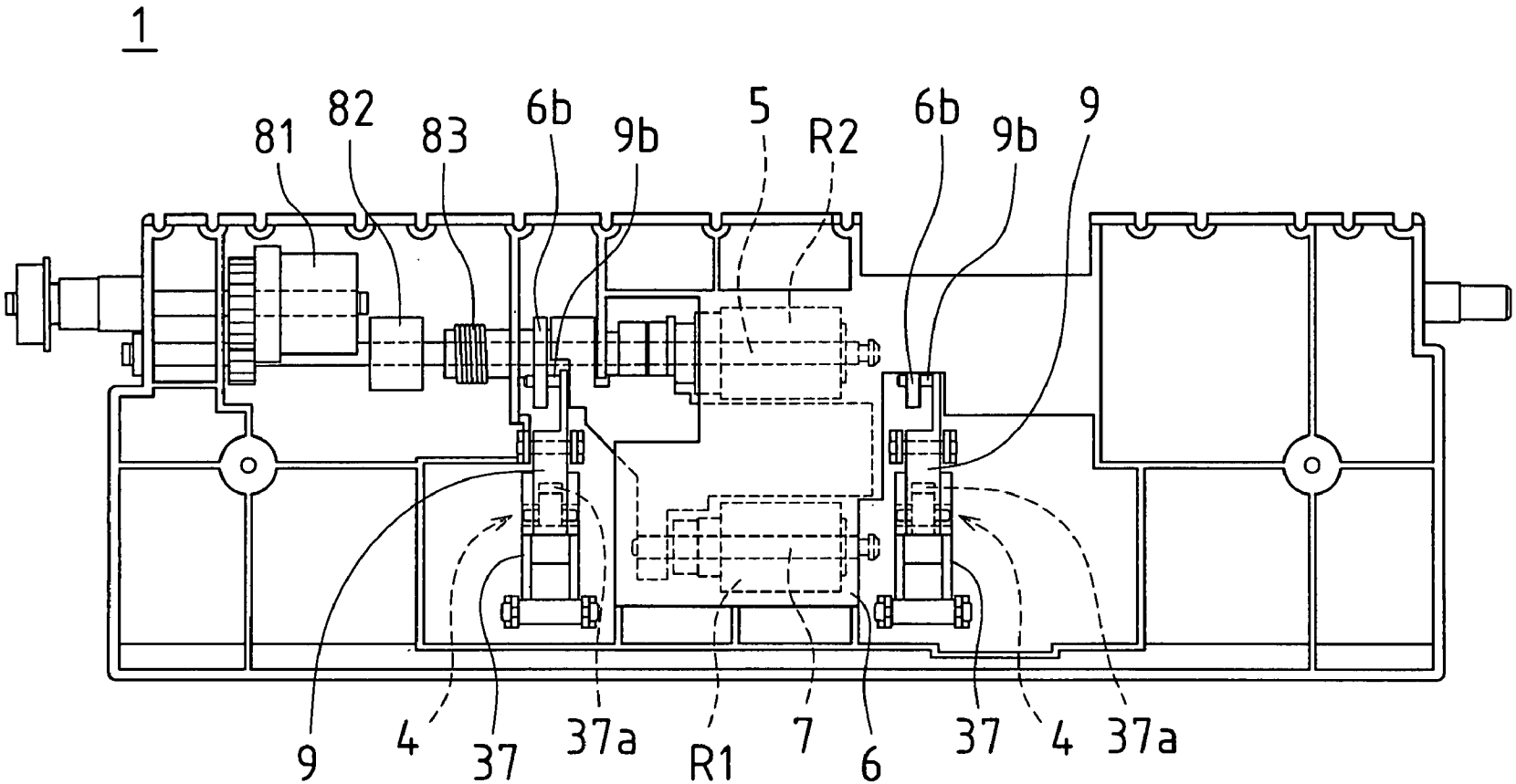
FIG. 4 is a schematic plan view of an original transport apparatus associated with a first embodiment of the present invention.

FIGS. 1 through 3 are vertical sectional views showing in schematic fashion the structure of an original transport apparatus in accordance with the present first embodiment. Furthermore, FIG. 4 is a schematic plan view of an original transport apparatus in accordance with the present first embodiment. Note that FIG. 1 shows the situation existing when original(s) 11 have been placed on original tray(s) 10, stopper member(s) 4 causing lead edge(s) of original(s) 11 to be stopped at prescribed location(s). But FIGS. 2 and 3 show situations existing during operations that might be carried out when a transport problem has occurred.

The basic structure of the original transport apparatus of the present first embodiment is identical to the structure of the conventional original transport apparatus shown in FIGS. 21 through 25. Accordingly, like members and like parts have been given like reference numerals, and detailed description thereof will be omitted here.

Where the original transport apparatus of the present first embodiment differs from the conventional original transport apparatus is with respect to the fact that whereas in the conventional original transport apparatus stopper member(s) 4 were supported so as to permit displacement in pivoting fashion by shaft(s) 3 rigidly disposed with respect to outer casing(s) 1, in the present first embodiment stopper member(s) 4 is/are supported so as to permit displacement in pivoting fashion by shaft(s) which is/are itself/themselves disposed so as to permit displacement up and/or down in pivoting fashion. For this reason, the present first embodiment adopts a constitution in which arm member(s) 37 has or have been added.

That is, the structure is such that one end of arm member 37 is, at the bottom region of outer casing 1, supported so as to permit displacement in pivoting fashion about shaft 38, which is arranged in a direction perpendicular to original transport direction X; shaft 3 of stopper member 4 being secured to other end of this arm member 37. Note that the one end of arm member 37 is supported so as to permit displacement in pivoting fashion by outer casing 1 at a location to the side of shaft 3 of stopper member 4 which is opposite post 8 of engagement piece 9.

Furthermore, the other end of arm member 37 extends beyond shaft 3 in the direction of post 8, the tip region of such extension being bent upward to form lifting piece 37*a* for lifting engagement piece 9 upward.

In an original transport apparatus constituted in such fashion, in the event of occurrence of a transport problem, drive control means causes pickup roller R1 to be displaced upward in pivoting fashion from a position at which it was beneath and not hidden by outer casing 1, this position having been occupied thereby when original takeup was proceeding, disengaging engagement between thrust pin 9*b* of engagement piece 9 and thrust piece 6*b* of pickup arm 6.

With the apparatus in this state, when outer casing 1 is opened due to occurrence of transport failure as shown in FIG. 2, originals 11 slide down original tray 10 under the force of their own weight and are displaced from the original loading location. Furthermore, engagement piece 9, having been in its freed orientation, is, as a result of disengagement, displaced in pivoting fashion such that it moves downward under the force of its own weight, engagement finger 9*a* of engagement piece 9 engaging with engagement finger 4*a* of stopper member 4, which is raised up thereto in accompaniment to opening of outer casing 1.

With the apparatus in the state, if outer casing 1 is now closed in the direction indicated by the arrow at reference numeral 94 in FIG. 2, bottom region 4*b* of stopper member 4 will, during the course of such closing operation, come to abut originals 11. But in the case of the original transport apparatus of the present first embodiment as shown in FIG. 3, arm member 37 is displaced in pivoting fashion as indicated by the arrow at reference numeral 95, and stopper member 4 is itself lifted up, as is engagement piece 9 which is lifted up together therewith. At such time, stopper member 4 being located between the axis about which pivoting of engagement piece 9 occurs and arm member 37, arm member 37 and engagement piece 9 separate from each other as rising proceeds, disengaging the engagement which had existed between the two engagement fingers 9*a*, 4*a*. Furthermore, at such time, because lifting piece 37*a* formed at the other end of arm member 37 lifts up engagement piece 9 still further, disengagement of engagement between the two engagement fingers 9*a*, 4*a* occurs in definitive fashion.

As a result, because stopper member 4 assumes the same state permitting displacement in pivoting fashion which it was in when original takeup was proceeding, it is possible to mitigate interference by stopper member 4 with respect to originals 11 and it is possible to prevent damage to originals 11.

Embodiment 2

Figure 5:
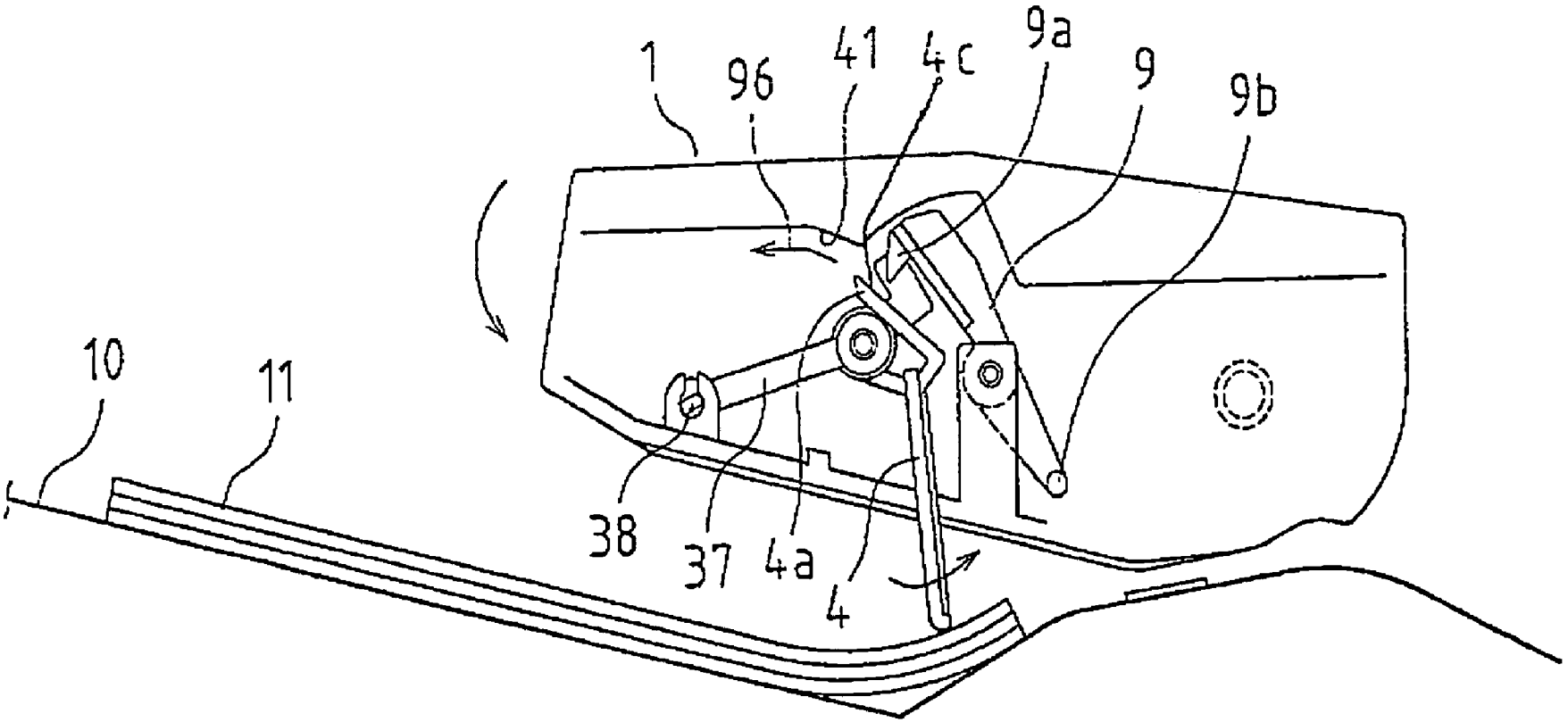
FIG. 5 is a vertical sectional view showing in schematic fashion the structure of an original transport apparatus associated with a second embodiment of the present invention.

FIG. 5 is a vertical sectional view showing in schematic fashion the structure of an original transport apparatus in accordance with the present second embodiment.

In order to more definitively prevent interference between stopper member 4 and originals 11 when outer casing 1 is closed, an original transport apparatus in accordance with the present second embodiment, in addition to having structure as at the original transport apparatus of the foregoing first embodiment, also has structure for lifting stopper member 4.

That is, as shown in FIG. 5, outer casing 1 is provided with guide component(s) causing stopper member 4 to be displaced in pivoting fashion such that it is raised upward when arm member 37 is displaced in pivoting fashion such that it subtends not less than a preestablished angle. More specifically, guide surface(s) 41 serving as guide component(s) is/are formed at top inside wall region(s) of outer casing 1. This being the case, when stopper member 4 is pushed upward, top region 4 thereof abuts guide surface 41 and slides therealong in the direction indicated by the arrow at reference numeral 96 so as to cause stopper member 4 to be displaced in pivoting fashion such that it is raised upward.

That is, during closing of outer casing 1, not only is engagement between engagement finger 4*a* of stopper member 4 and engagement finger 9*a* of engagement piece 9 disengaged, but it is also the case that further closing of outer casing 1 causes stopper member 4 to rise further as the top region thereof is guided by guide surface 41. Accordingly, damage to originals 11 and/or stopper member 4 can be definitively prevented even where operations for opening and/or closing outer casing 1 are carried out while originals 11 are loaded in original tray 10.

Embodiment 3

Figure 6:
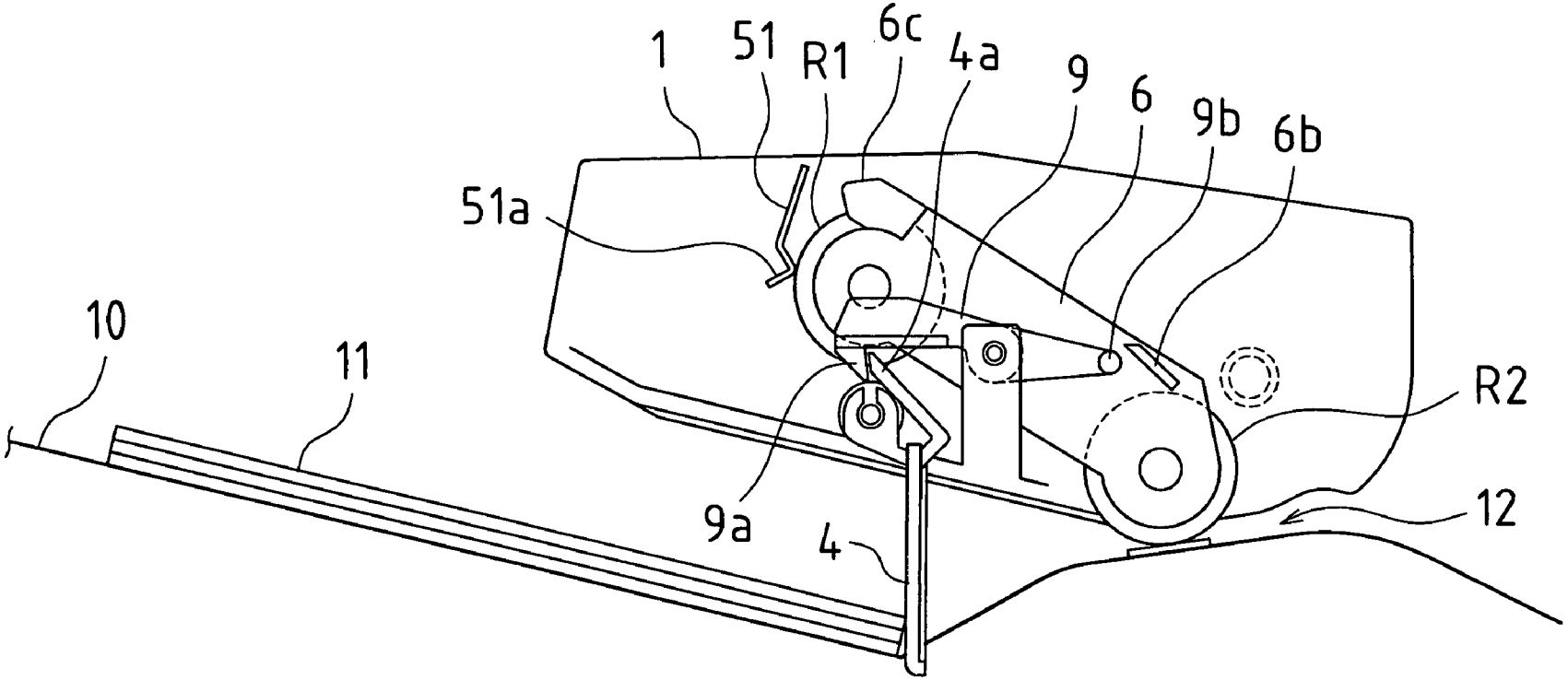
FIG. 6 is a vertical sectional view showing in schematic fashion the structure of an original transport apparatus associated with a third embodiment of the present invention.
Figure 7:
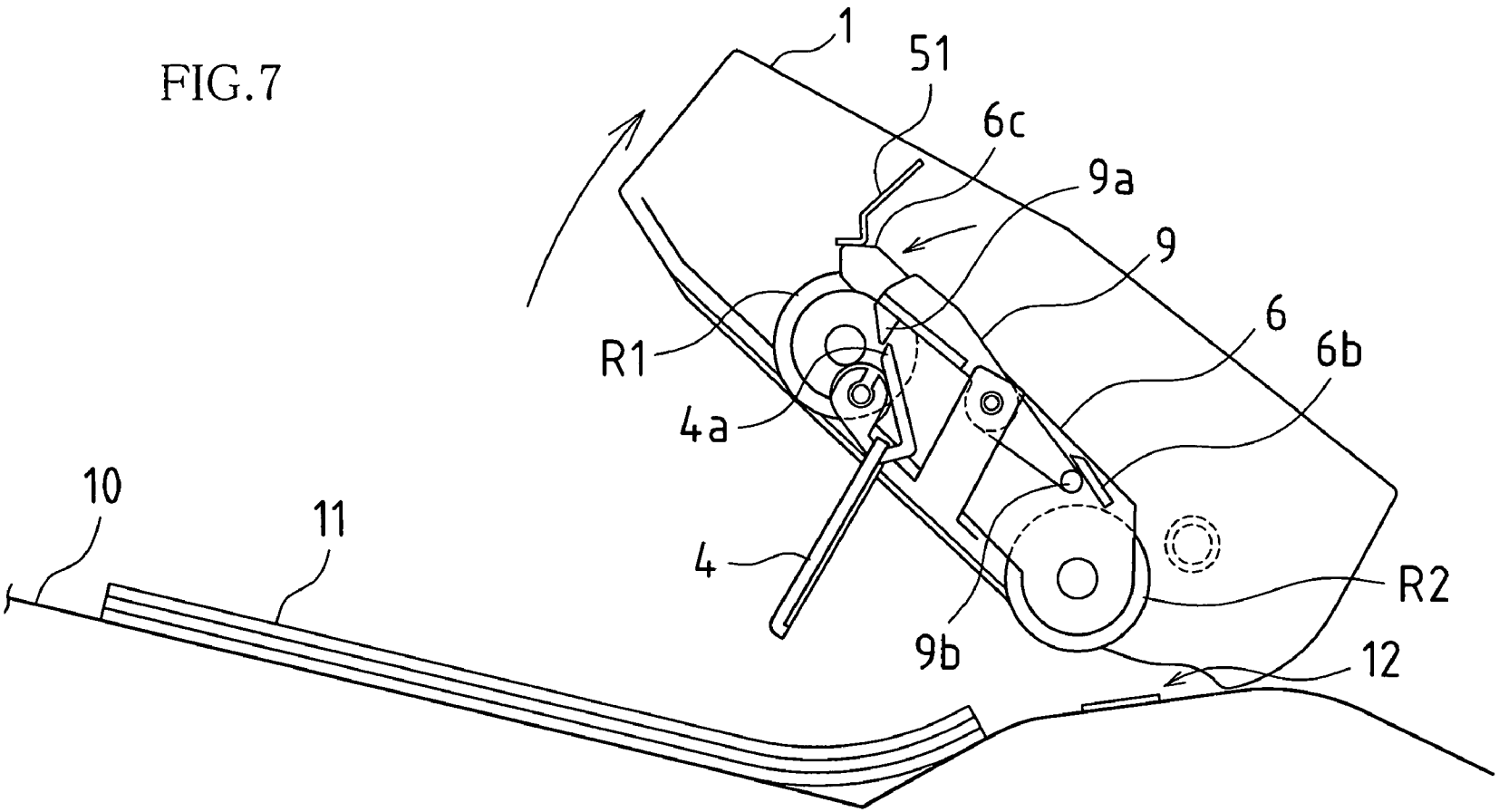
FIG. 7 is a vertical sectional view showing in schematic fashion the structure of an original transport apparatus associated with a third embodiment of the present invention.
Figure 8:
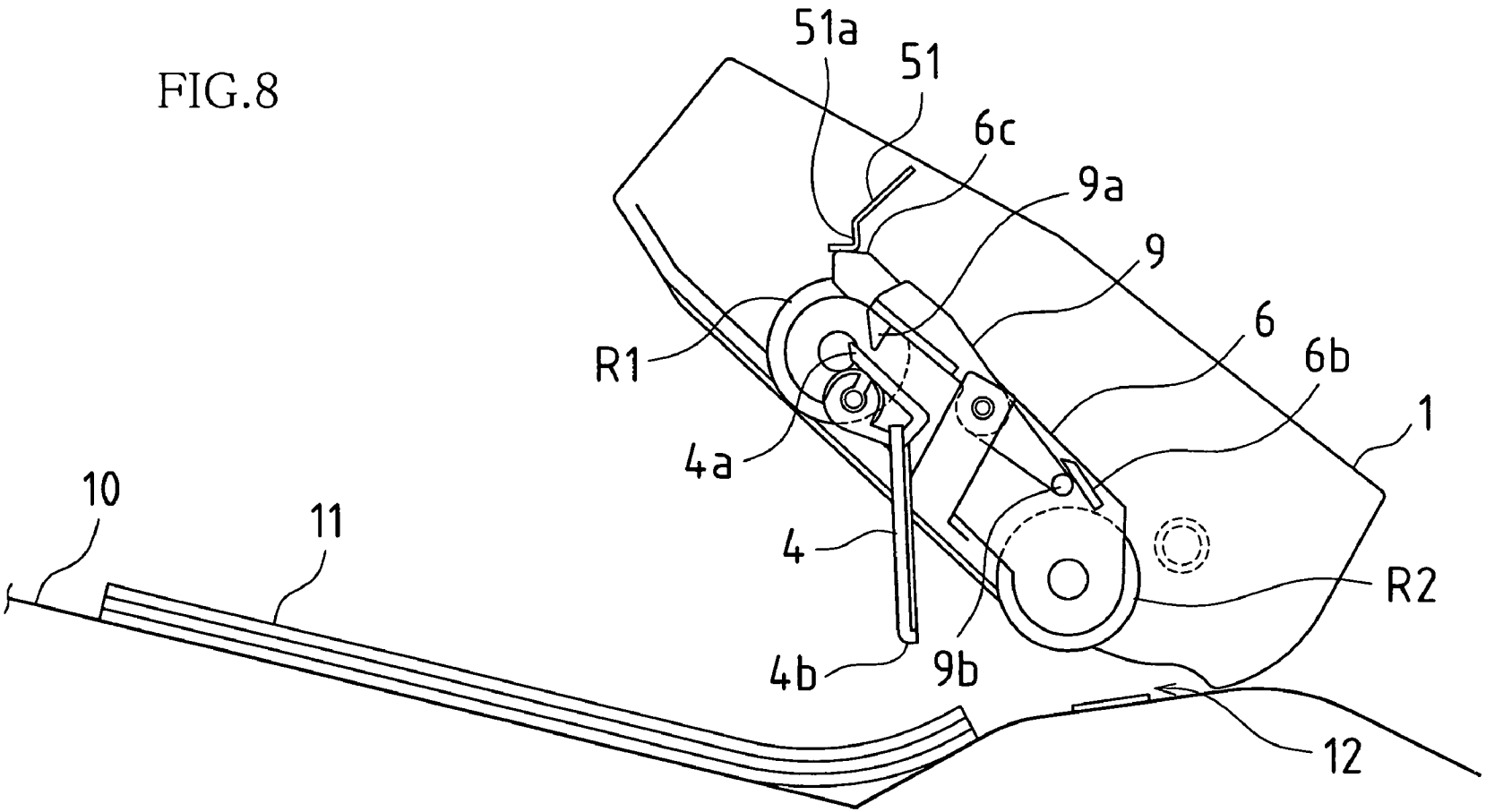
FIG. 8 is a vertical sectional view showing in schematic fashion the structure of an original transport apparatus associated with a third embodiment of the present invention.
Figure 9:
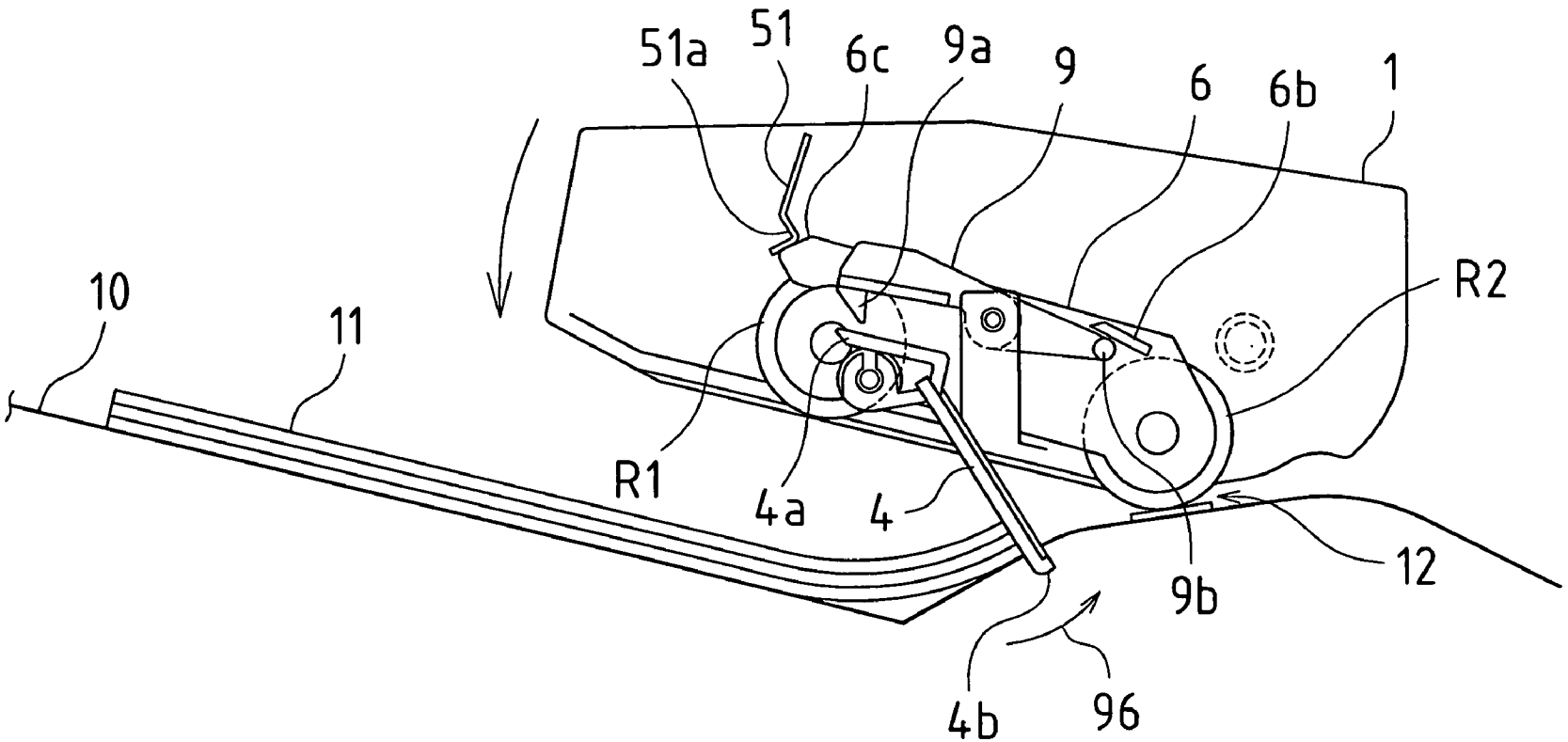
FIG. 9 is a vertical sectional view showing in schematic fashion the structure of an original transport apparatus associated with a third embodiment of the present invention.
Figure 10:
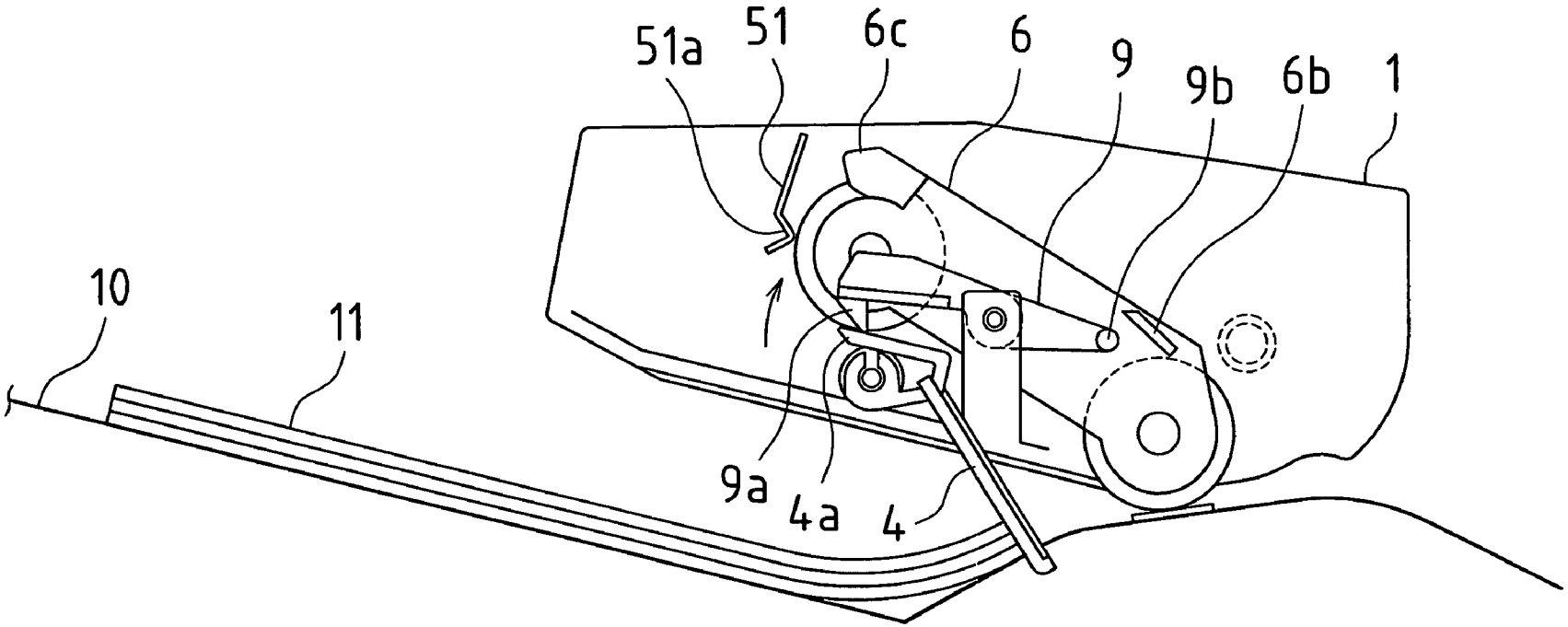
FIG. 10 is a vertical sectional view showing in schematic fashion the structure of an original transport apparatus associated with a third embodiment of the present invention.
Figure 11:
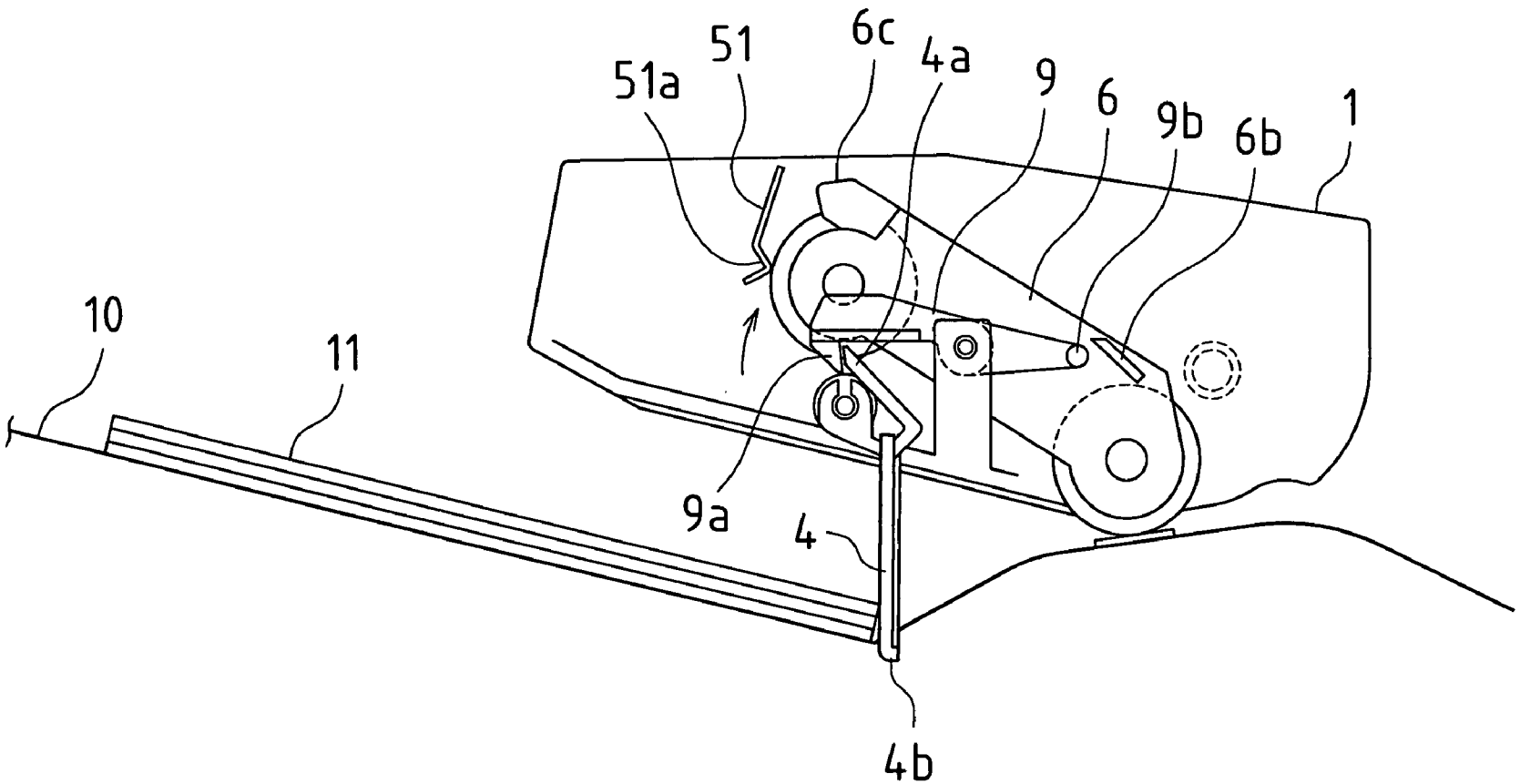
FIG. 11 is a vertical sectional view showing in schematic fashion the structure of an original transport apparatus associated with a third embodiment of the present invention.

FIGS. 6 through 11 are vertical sectional views showing in schematic fashion the structure of an original transport apparatus in accordance with the present third embodiment. Note that FIG. 6 shows the situation existing when original(s) 11 have been placed on original tray(s) 10, stopper member(s) 4 causing lead edge(s) of original(s) 11 to be stopped at prescribed location(s). Furthermore, FIGS. 7 and 8 show situations existing during operations carried out when outer casing 1 is opened due to occurrence of a transport problem, while FIGS. 9 through 11 show situations existing during operations carried out when outer casing 1 is closed after having been opened.

The basic structure of the original transport apparatus of the present third embodiment is identical to the structure of the conventional original transport apparatus shown in FIGS. 21 through 25. Accordingly, like members and like parts have been given like reference numerals, and detailed description thereof will be omitted here.

Characteristic of the structure of the original transport apparatus of the present third embodiment is the fact that there is a first standby position (the position shown in FIG. 6) at which thrust piece 6*b* of pickup arm 6 and thrust pin 9*b* of engagement piece 9 are not engaged but at which engagement finger 9*a* of engagement piece 9 and engagement finger 4*a* of stopper member 4 are engaged, and there is a second standby position (the position shown in FIGS. 7 and 8), between the first standby position and a position (the position shown in FIG. 22) occupied when takeup of originals is proceeding and pickup roller R1 has moved downward and away from outer casing 1 so as to not be hidden thereby, at which thrust piece 6*b* of pickup arm 6 and thrust pin 9*b* of engagement piece 9 are engaged but at which engagement finger 9*a* of engagement piece 9 and engagement finger 4*a* of stopper member 4 are disengaged; and the fact that plate spring 51—serving as retaining member—is provided at outer casing 1, plate spring 51 retaining pickup arm 6 when the second standby position is occupied. That is, the present third embodiment adopts a constitution in which plate spring 51, having ridged detente region 51*a* formed such that the tip thereof is bent in v-like fashion, is added to the structure of the conventional original transport apparatus; and in which ridged detente projection region 6*c*, which binds with detente region 51*a* of plate spring 51, is provided at the free side of pickup arm 6.

In accordance with the foregoing constitution, in terms of the relative positional relationship with respect to outer casing 1, when outer casing 1 is opened as shown in FIG. 7, drive control means, which drives pickup arm 6 so as to displace it in pivoting fashion, drives pickup arm 6 and displaces it in pivoting fashion to the second standby position; and at the second standby position, pickup roller R1 is retained at a point partway through its ascent (partway through the ascent caused by the restoring force from pickup arm spring 83 (see FIG. 25)), in which state engagement between engagement finger 9*a* of engagement piece 9 and engagement finger 4*a* of stopper member 4 is disengaged (see FIG. 8).

Accordingly, even if outer casing 1 is closed with the apparatus in this state, stopper member 4 not being engaged with engagement piece 9, the bottom region 4*b* thereof abuts originals 11 and bottom region 4*b* of stopper member 4 thereafter slides over the surface of originals 11; so that, as shown in FIG. 9, stopper member 4 is raised up in the direction indicated by the arrow at reference numeral 96 as outer casing 1 is closed. This makes it possible to mitigate interference by stopper member 4 with respect to originals 11 and makes it possible to prevent damage to originals 11.

Thereafter, when outer casing 1 is completely closed, drive control means, as shown in FIG. 10, raises pickup arm 6 back up to the first standby position. As a result, engagement between thrust pin 9*b* of engagement piece 9 and thrust piece 6*b* of pickup arm 6 is disengaged, engagement piece 9 is displaced in pivoting fashion such that the engagement finger 9*a* side thereof moves downward under the force of its own weight, and the tip of engagement finger 9*a* abuts the back surface of stopper member 4.

With the apparatus in this state, if originals 11 are again placed on original tray 10, stopper member 4, which had been in its upward position, pivots under the force of its own weight to return to a roughly vertical orientation, this pivoting causing engagement finger 9*a* of engagement piece 9, which had been abutting the back surface of stopper member 4, to surmount the tip region of stopper member 4 and to, as shown in FIG. 11, become engaged with engagement finger 4*a* of stopper member 4. As a result, lead edges of originals 11 are aligned at a prescribed location, and entry of originals 11 into transport path 12 is prevented.

Embodiment 4

Figure 12:
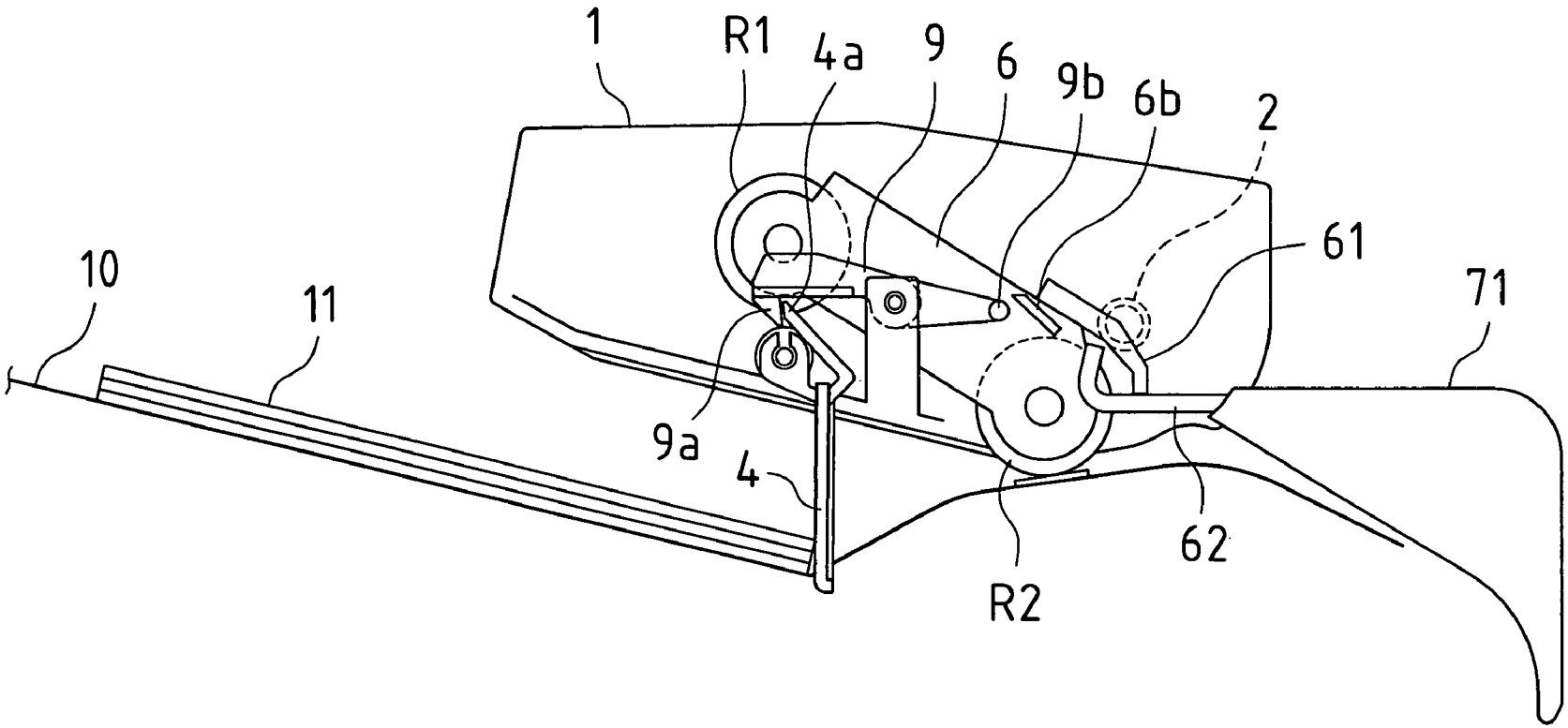
FIG. 12 is a vertical sectional view showing in schematic fashion the structure of an original transport apparatus associated with a fourth embodiment of the present invention.
Figure 13:
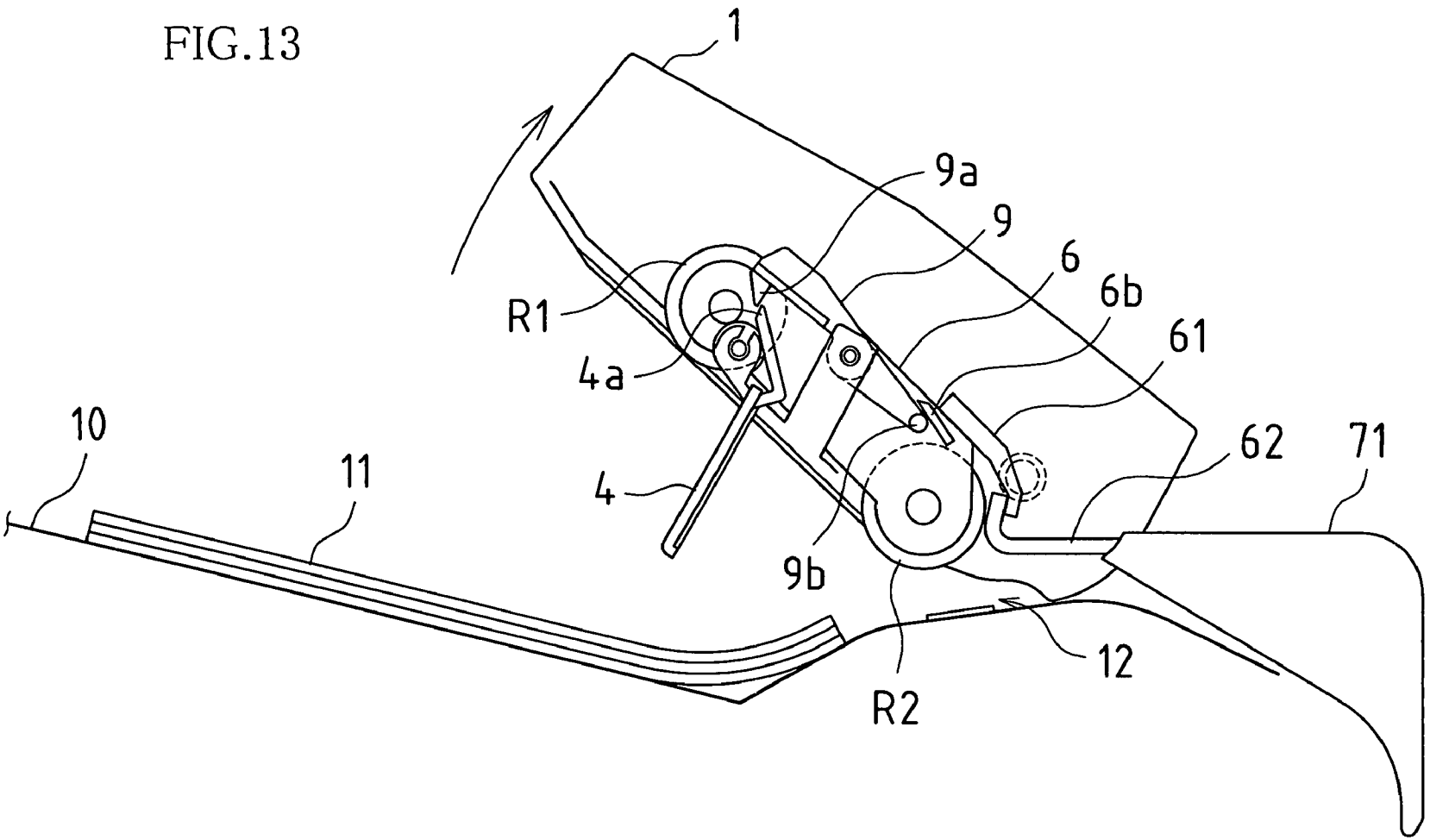
FIG. 13 is a vertical sectional view showing in schematic fashion the structure of an original transport apparatus associated with a fourth embodiment of the present invention.
Figure 14:
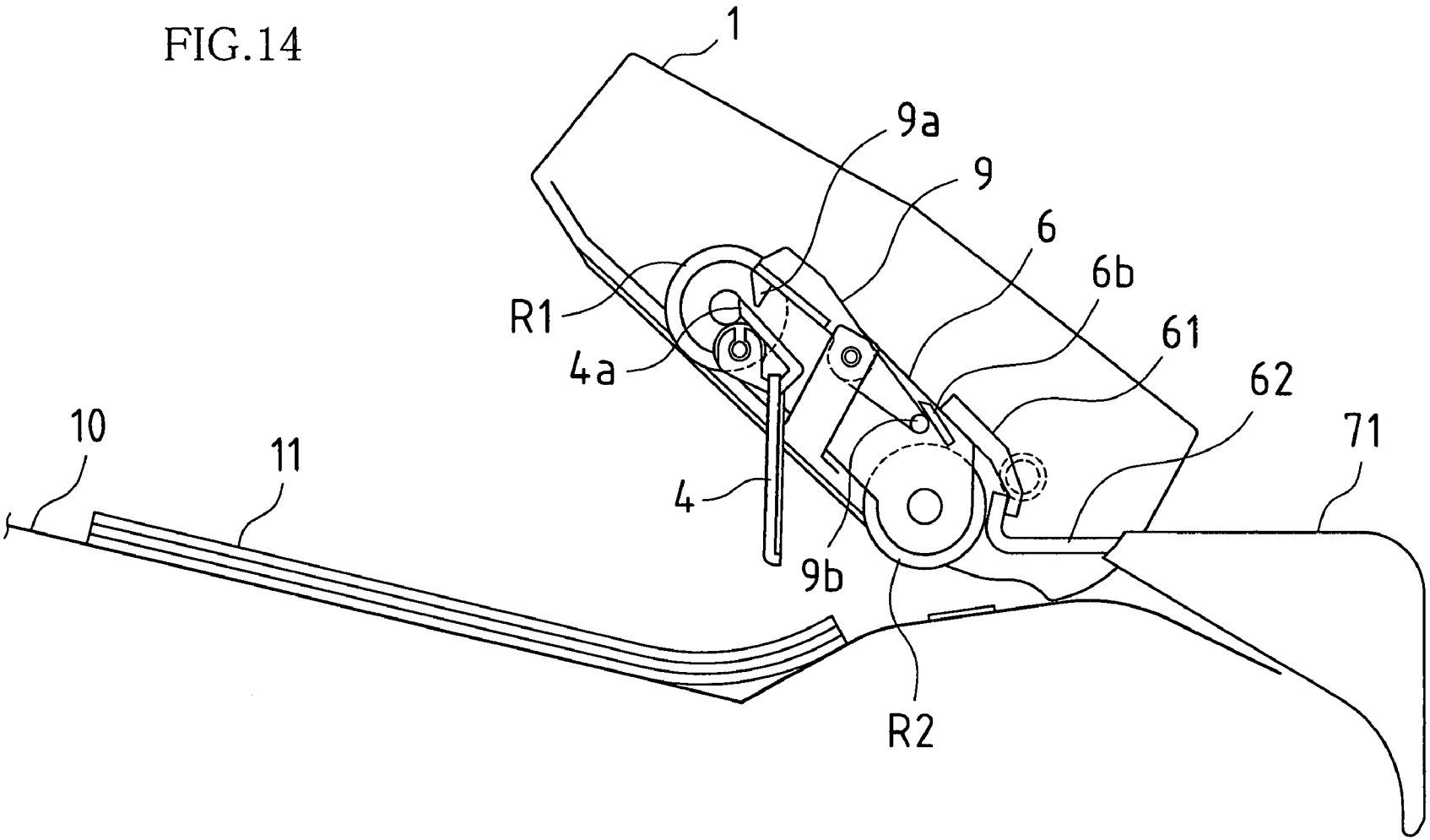
FIG. 14 is a vertical sectional view showing in schematic fashion the structure of an original transport apparatus associated with a fourth embodiment of the present invention.
Figure 15:
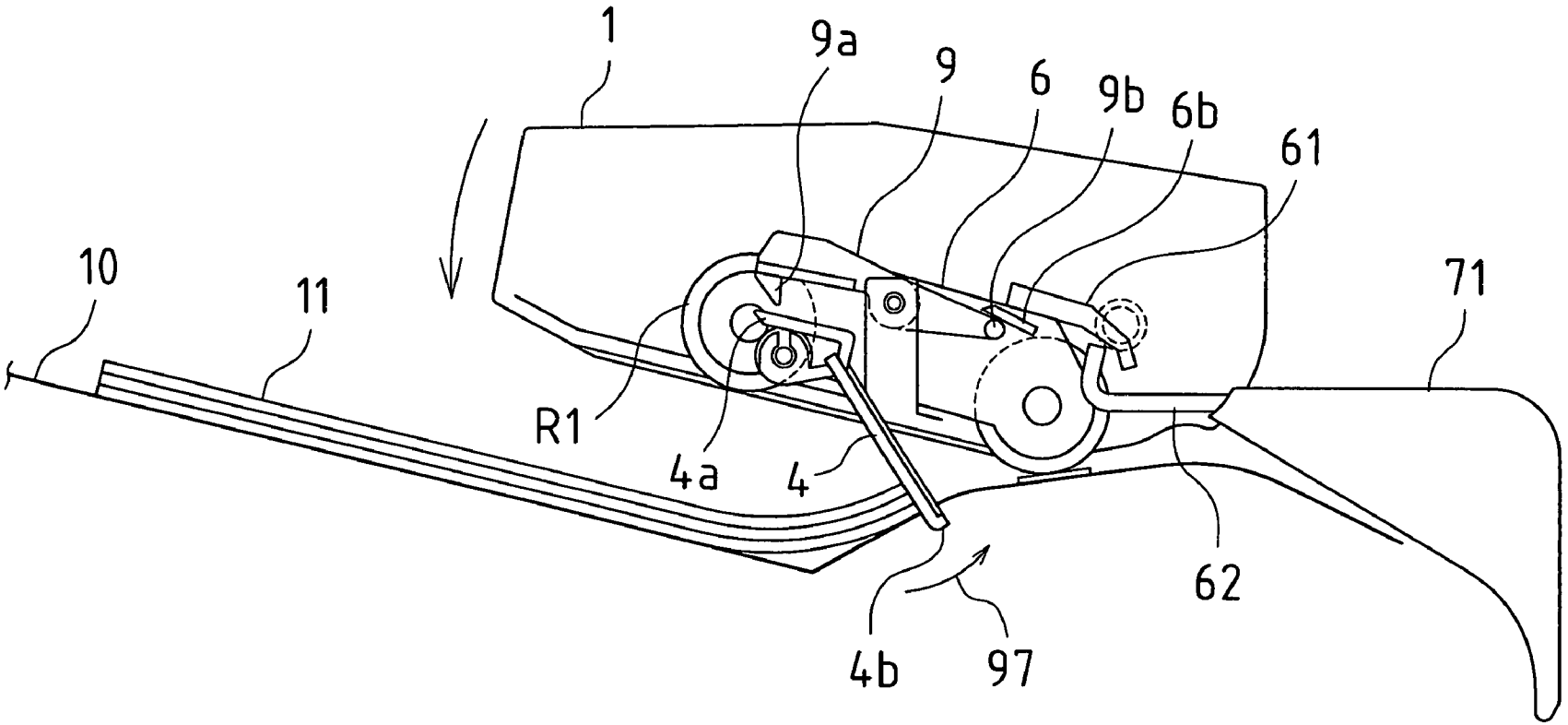
FIG. 15 is a vertical sectional view showing in schematic fashion the structure of an original transport apparatus associated with a fourth embodiment of the present invention.
Figure 16:
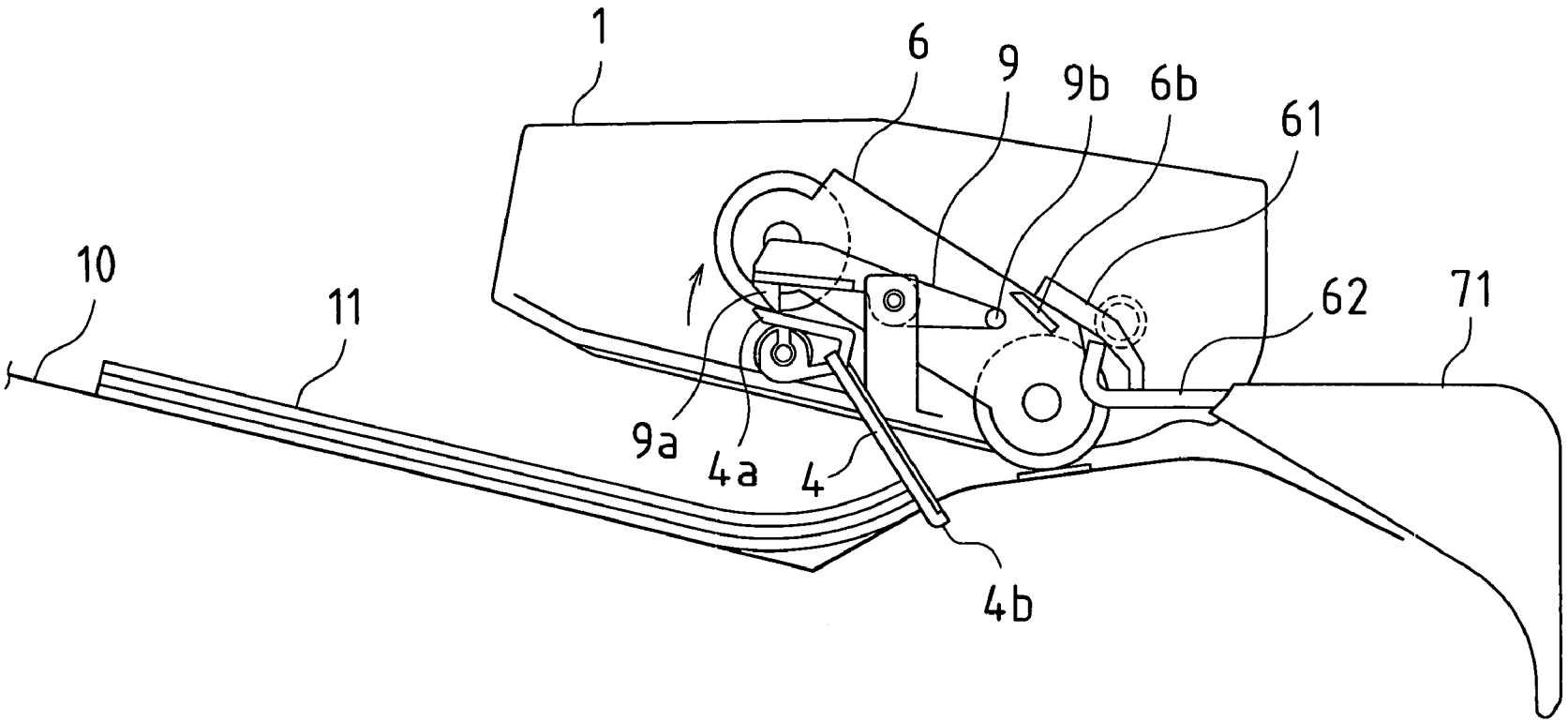
FIG. 16 is a vertical sectional view showing in schematic fashion the structure of an original transport apparatus associated with a fourth embodiment of the present invention.
Figure 17:
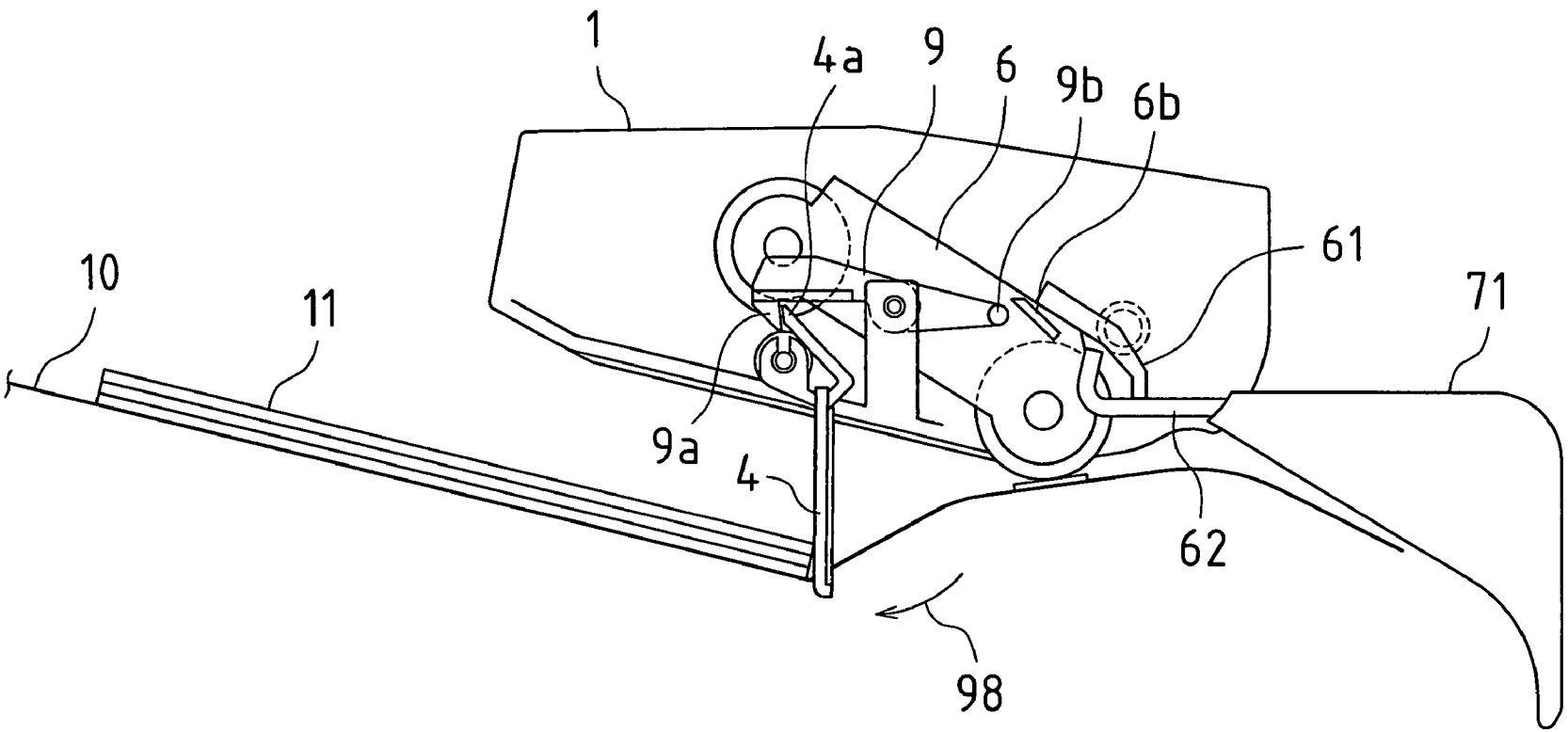
FIG. 17 is a vertical sectional view showing in schematic fashion the structure of an original transport apparatus associated with a fourth embodiment of the present invention.

FIGS. 12 through 17 are vertical sectional views showing in schematic fashion the structure of an original transport apparatus in accordance with the present fourth embodiment. Note that FIG. 12 shows the situation existing when original(s) 11 have been placed on original tray(s) 10, stopper member(s) 4 causing lead edge(s) of original(s) 11 to be stopped at prescribed location(s). Furthermore, FIGS. 13 and 14 show situations existing during operations carried out when outer casing 1 is opened due to occurrence of a transport problem, while FIGS. 15 through 17 show situations existing during operations carried out when outer casing 1 is closed after having been opened.

The basic structure of the original transport apparatus of the present fourth embodiment is identical to the structure of the conventional original transport apparatus shown in FIGS. 21 through 25. Accordingly, like members and like parts have been given like reference numerals, and detailed description thereof will be omitted here.

Characteristic of the structure of the original transport apparatus of the present fourth embodiment is the fact that there is a first standby position (the position shown in FIG. 12) at which thrust piece 6*b* of pickup arm 6 and thrust pin 9*b* of engagement piece 9 are not engaged but at which engagement finger 9*a* of engagement piece 9 and engagement finger 4*a* of stopper member 4 are engaged, and there is a second standby position (the position shown in FIGS. 13 and 14), between the first standby position and a position (the position shown in FIG. 22) occupied when takeup of originals is proceeding and pickup roller R1 has moved downward and away from outer casing 1 so as to not be hidden thereby, at which thrust piece 6*b* of pickup arm 6 and thrust pin 9*b* of engagement piece 9 are engaged but at which engagement finger 9*a* of engagement piece 9 and engagement finger 4*a* of stopper member 4 are disengaged, and the fact that retaining member(s) provided at outer casing 1 retain pickup arm 6 when the second standby position is occupied—the present fourth embodiment being similar to the foregoing third embodiment in these respects—but also characteristic of the present fourth embodiment is the fact that, instead of plate spring 51 of the foregoing third embodiment, pivot projection 61 is provided at the basal side, about which pivoting occurs, of pickup roller 6; and pivot constraining rod 62, which constrains pivoting of the aforesaid pivot projection 61, is provided at apparatus main body (a U-turn guide in the present embodiment) 71.

That is, pivot projection 61 and pivot constraining rod 62 are not mutually engaged when outer casing 1 is in a closed state as shown in FIG. 12, but are mutually engaged when outer casing 1 is in an open state as shown in FIGS. 13 and 14; and in terms of the relative positional relationship with respect to outer casing 1, pickup arm 6 is driven such that it is displaced in pivoting fashion to the second standby position (rising being restrained), disengaging engagement between engagement finger 9*a* of engagement piece 9 and engagement finger 4*a* of stopper member 4 (FIGS. 13 and 14).

Accordingly, even if outer casing 1 is closed with the apparatus in this state, stopper member 4 not being bound, the bottom region 4*b* thereof abuts originals 11 and bottom region 4*b* of stopper member 4 thereafter slides over the surface of originals 11; so that, as shown in FIG. 15, stopper member 4 is raised up in the direction indicated by the arrow at reference numeral 97 as outer casing 1 is closed. This makes it possible to mitigate interference by stopper member 4 with respect to originals 11 and makes it possible to prevent damage to originals 11.

Thereafter, when outer casing 1 is closed, because pivot constraining rod 61 is disengaged therefrom, the spring force from pickup arm spring 83 causes the pickup arm to be lifted up. As a result, engagement between thrust pin 9*b* of engagement piece 9 and thrust piece 6*b* of pickup arm 6 is disengaged, engagement piece 9 is displaced in pivoting fashion such that the engagement finger 9*a* side thereof moves downward under the force of its own weight, and the tip of engagement finger 9*a* abuts the back surface of stopper member 4 (see FIG. 16).

With the apparatus in this state, if originals 11 are again placed on original tray 10, stopper member 4, which had been in its upward position, pivots under the force of its own weight (as indicated by the arrow at reference numeral 98 in FIG. 17) to return to a roughly vertical orientation, this pivoting causing engagement finger 9*a* of engagement piece 9, which had been abutting the back surface of stopper member 4, to surmount the tip region of stopper member 4 and to become engaged with engagement finger 4*a* of stopper member 4. As a result, lead edges of originals 11 are aligned at a prescribed location, and entry of originals 11 into transport path 12 is prevented.

Description of Original Capturing Apparatus

The foregoing concludes description of original transport apparatuses associated with the present invention; an original capturing apparatus equipped with such an original transport apparatus will next be described.

Figure 18:
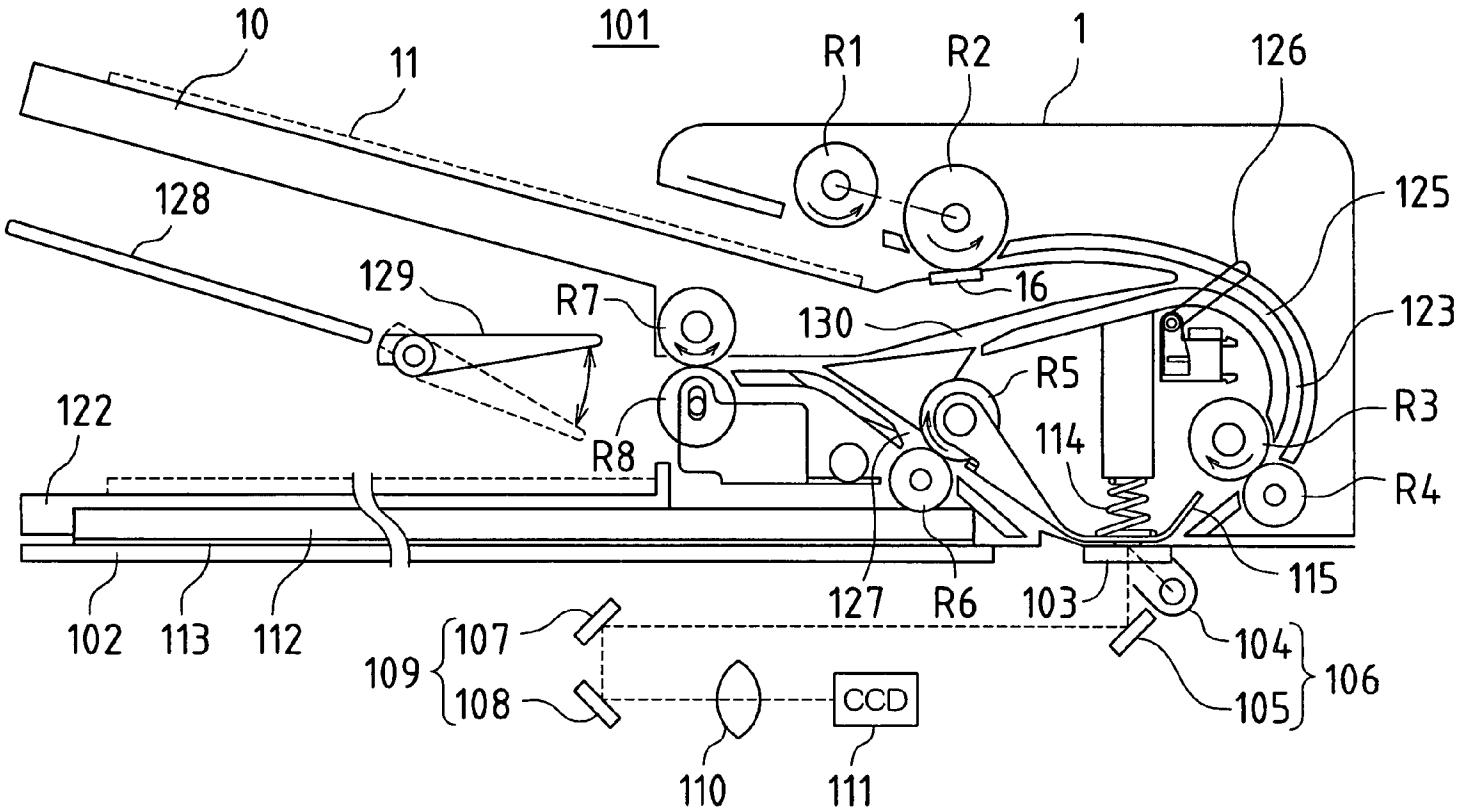
FIG. 18 is a vertical sectional view of an original capturing apparatus equipped with an original transport apparatus in accordance with the present invention.

FIG. 18 is a vertical sectional view of original capturing apparatus 101 equipped with an original transport apparatus constituted as described above. Note that, at FIG. 18, features characteristic of original transport apparatuses in accordance with the present invention are not shown.

This original capturing apparatus 101 is capable of capturing images of originals 11 placed on original stage 102 while such originals are stationary, and is capable of capturing images of originals 11 at another original stage 103 while such originals are being transported therepast. Provided in order to permit such capture, below original stages 102, 103 there are light source unit 106 comprising light source 104 and mirror 105; mirror unit 109 comprising mirrors 107, 108; imaging lens 110; and CCD capturing unit 111.

During stationery capture using original stage 102, beneath this original stage 102, light source unit 106 is moved in scanning fashion at velocity V and mirror unit 109 is moved in scanning fashion at velocity V/2, an image of the entire surface of the original being captured as the optical path length to CCD capturing unit 111 is held constant. Furthermore, during moving capture using original stage 103, beneath this original stage 103, mirror unit 109 is stationary, an image of the entire surface of the original being captured due to the fact that the original is transported in the manner described below. Furthermore, arranged opposite original stage 102 is original backpressure plate 113, which is provided at the back surface of original cover 112; and arranged opposite original stage 103 is original backpressure plate 115, which is acted upon by a restoring force from biasing spring 114 urging it toward original stage 103.

In broad terms, the sheet transport mechanism of this original capturing apparatus 101 is made up of original tray 10 disposed above, relatively speaking; original discharge tray 122 which is disposed below this original tray 10; and curved transport path 123 which connects the other two.

Originals 11 loaded in original tray 10 are taken up by pickup roller R1 and are separated by separation roller R2 and separation plate 16 such that a single sheet at a time is transported to main transport path 125 forming curved transport path 123. After transport of the transported original has been confirmed by means of original insertion sensor 126, any skew in the original lead edge is corrected, and the original is transported toward the original capture component associated with original stage 103 by way of drive roller R3 and idler roller R4 which is paired therewith, these comprising timing rollers (PS rollers) causing the original to advance with prescribed image capture timing, as a result of which capture of an image of the original takes place.

After image capture has been completed, the original is removed from the capture component by means of a pair of transport rollers R5, R6, and is discharged to original discharge tray 122 by way of discharge path 127 by means of a pair of discharge rollers R7, R8 capable of being driven in reverse rotational fashion.

Furthermore, at this original capturing apparatus 101, intermediate tray 128 is provided between original tray 10 and original discharge tray 122, and pivot plate 129 is provided adjacent to discharge rollers R7, R8, the original being discharged from discharge rollers R7, R8 to original discharge tray 122 when pivot plate 129 is in its upward orientation (first position) as indicated by the solid line in FIG. 18, or being diverted upward by pivot plate 129 so as to be discharged from discharge rollers R7, R8 to intermediate tray 128 when pivot plate 129 is inclined downward (in its second position) as indicated by the dashed line therein.

Intermediate tray 128 and pivot plate 129 are provided in order to permit capture of both the front and the back surface of the original, and an original transported along discharge path 127 and discharged by discharge rollers R7, R8 may be discharged into this intermediate tray 128, and transport might be paused with the trail edge thereof held in the nip formed between discharge rollers R7, R8. By thereafter reversing discharge rollers R7, R8, the original would to be made to enter auxiliary transport path 130, and from this auxiliary transport path 130 would be made to reenter curved transport path 123. In this way, an image of the top surface of an original loaded in original tray 10 would first be captured, and an image of the back surface of the original would then be captured through flipping transport accomplished by means of discharge path 127; discharge rollers R7, R8; pivot plate 129; intermediate tray 128; and auxiliary transport path 130.

Description of Image Capturing Operations Carried Out at Original Capturing Apparatus 101

Figure 19:
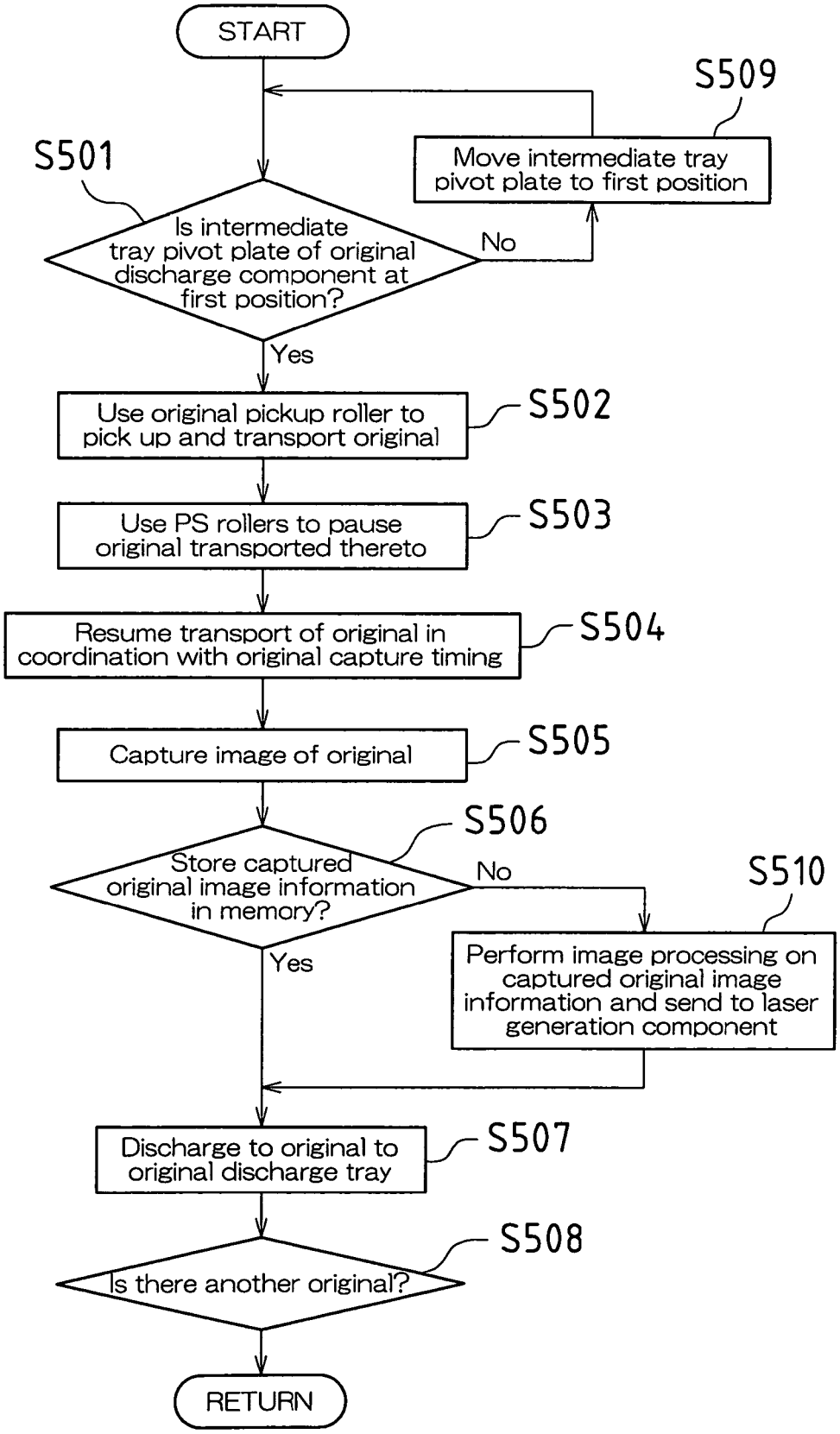
FIG. 19 is a flowchart showing operations during single-sided original capture at an original capturing apparatus.

FIG. 19 is a flowchart showing operations during single-sided original capture at original capturing apparatus 101 constituted as described above. Below, operations taking place during single-sided original capture are described with reference to this flowchart.

First, when single-sided image capture processing has been selected, determination is made as to whether pivot plate 129 at intermediate tray 128 of the original discharge component is at its first position (step S501). The first position here, as described above, refers to the orientation indicated by the solid line in FIG. 18, this orientation being for guiding the original to original discharge tray 122 following image capture.

If the result of determination at step S501 is that pivot plate 129 at intermediate tray 128 is not at its first position, then pivot plate 129 is moved to its first position (step S509).

After thus establishing the position of pivot plate 129, the original is transported by pickup roller R1 for original supply (step S502), and as described above, the original is paused by drive roller R3 (step S503), resumption of transport being coordinated with the timing of original capture (step S504).

Image capture of the transported original takes place at the original capture component (step S505). At this time, determination is made as to whether the captured original should be input into controller memory (step S506). This determination is made based on whether printing of only a single sheet or of multiple sheets was specified when the number of sheets to be printed was set. At step S506, printing of multiple sheets is indicated where the captured original is to be input into memory; printing of a single sheet is indicated where the captured original is not to be input into memory but image information captured from the original is instead to be subjected to image processing at the controller and is to thereafter be sent directly to the laser generation component of the image forming component. Moreover, where a single sheet is to be printed ("No" as determined at step S506), image information captured from the original is subjected to image processing and is sent to the laser generation component (step S510).

While such image processing is being carried out, the original is transported by way of transport rollers R5, R6 to discharge rollers R7, R8, which are rotating in the original discharge direction; and because pivot plate 129 is in its first position, the original is discharged onto original discharge tray 122 (step S507).

Such operations carried out by the original transport mechanism and the original capture component permit single-sided original capture to be carried out. It goes without saying that originals which may be subjected to such single-sided capture include those having original images on only one side thereof, as well as those having original images on both sides thereof but for which the operator has nonetheless specified that only single-sided capture should be carried out with respect thereto.

Figure 20:
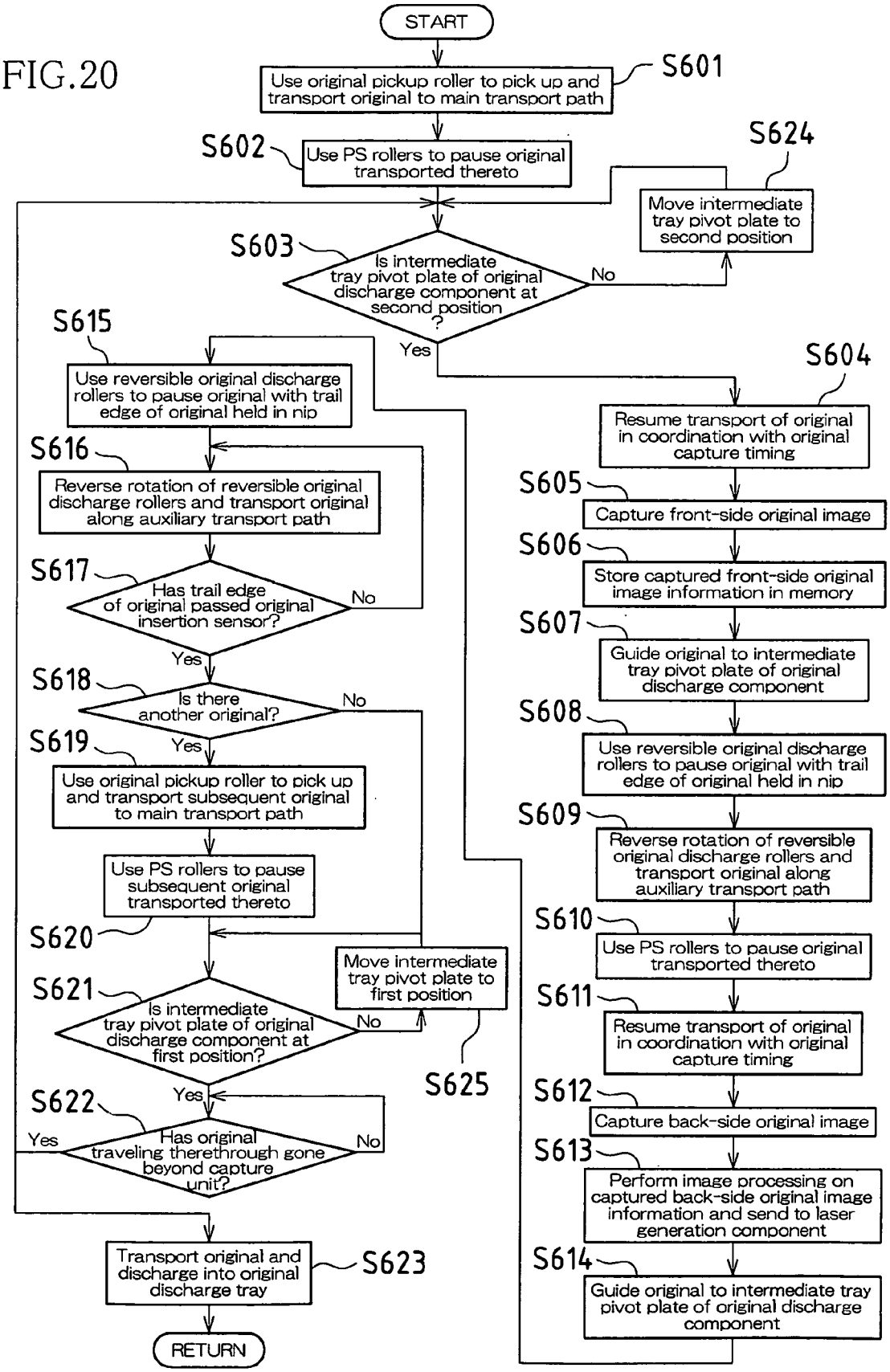
FIG. 20 is a flowchart showing operations during double-sided original capture at an original capturing apparatus.
Figure 21:
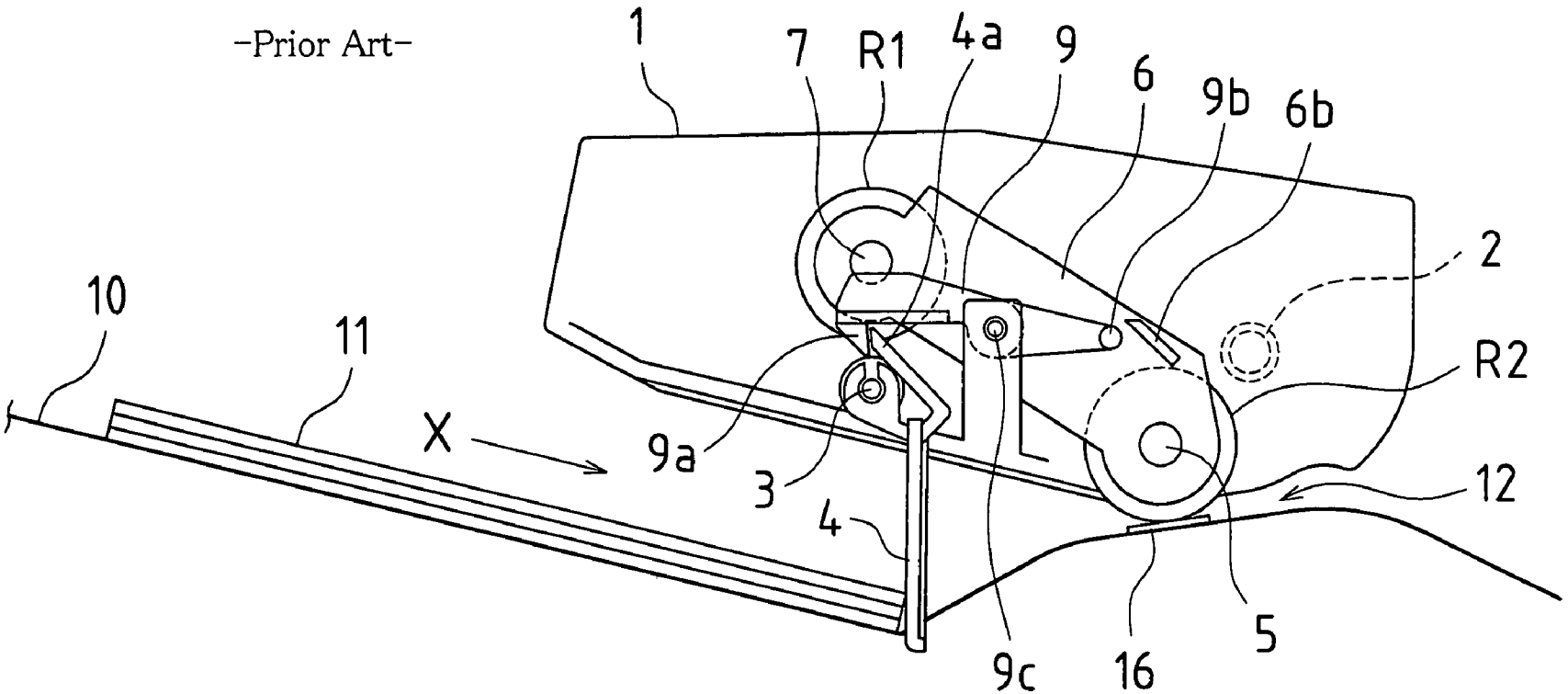
FIG. 21 is a vertical sectional view showing in schematic fashion the structure of a conventional original transport apparatus.
Figure 22:
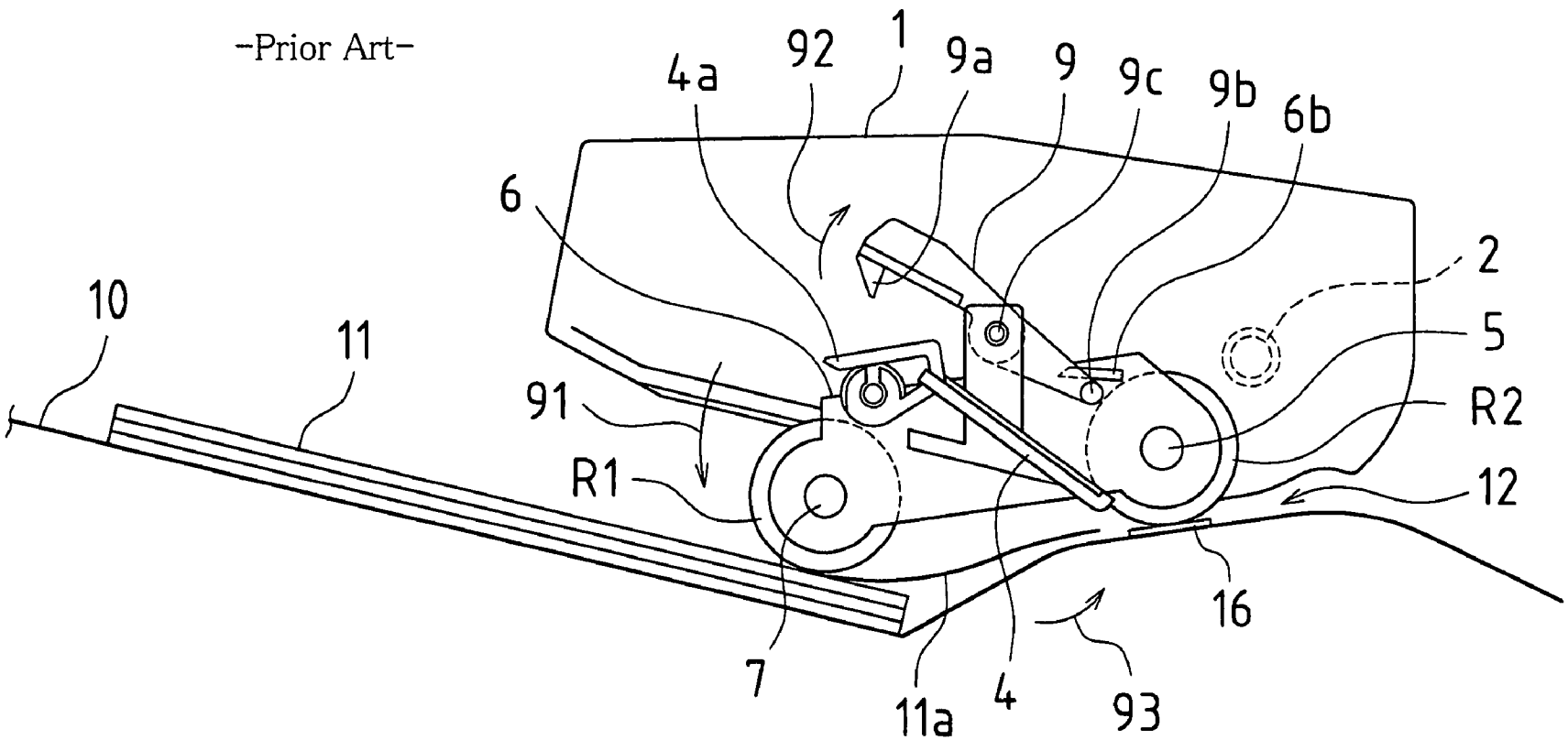
FIG. 22 is a vertical sectional view showing in schematic fashion the structure of a conventional original transport apparatus.
Figure 23:
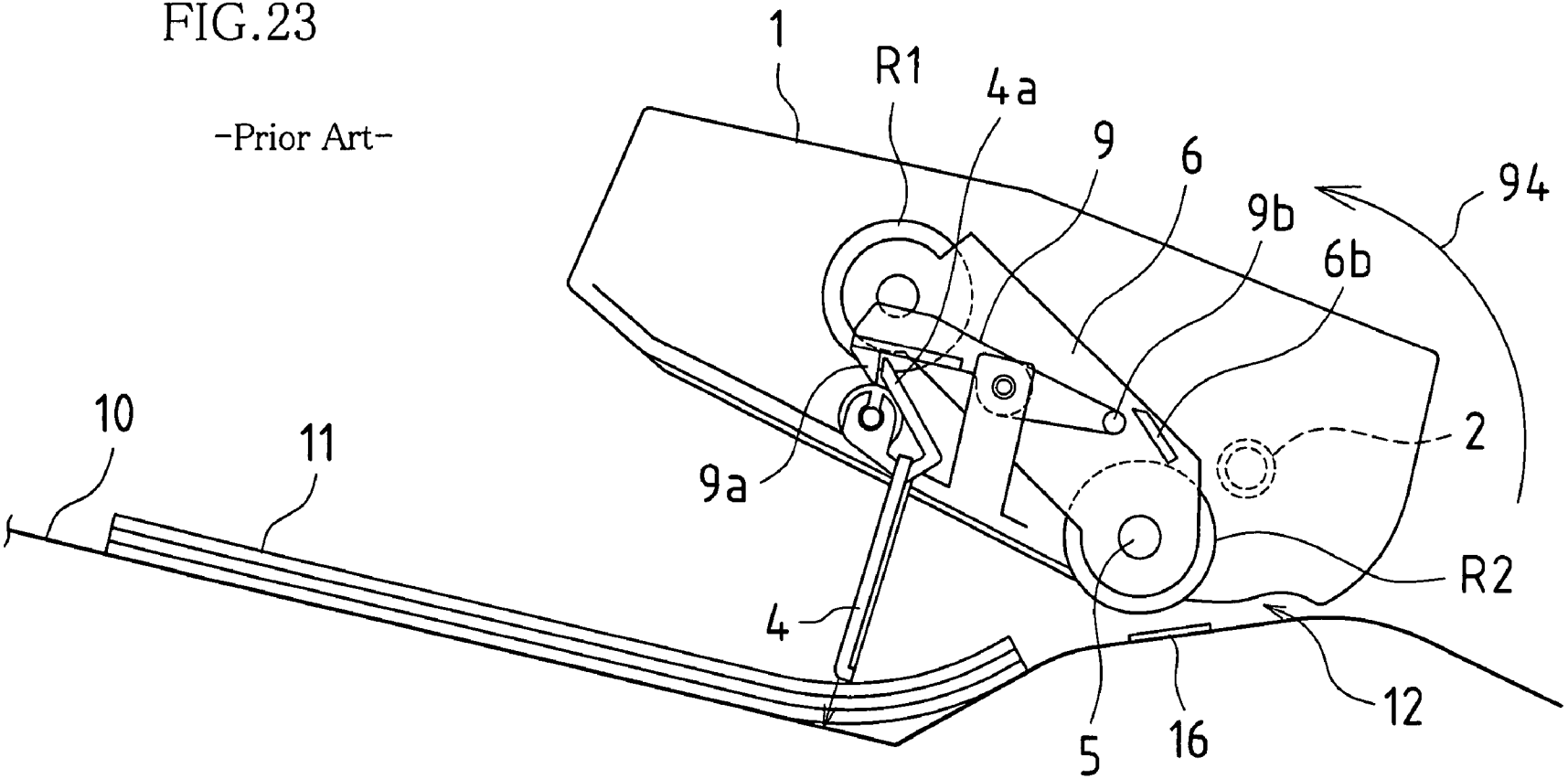
FIG. 23 is a vertical sectional view showing in schematic fashion the structure of a conventional original transport apparatus.
Figure 24:
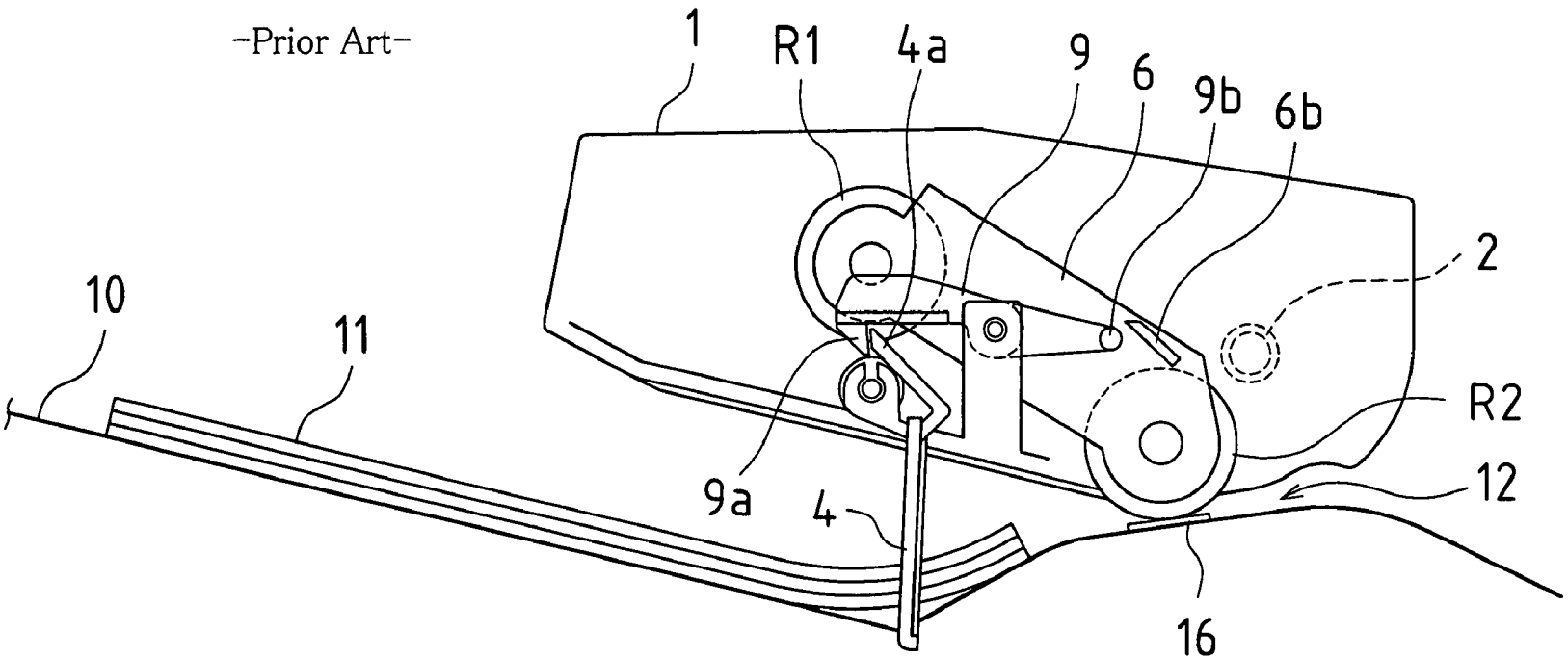
FIG. 24 is a vertical sectional view showing in schematic fashion the structure of a conventional original transport apparatus.
Figure 25:
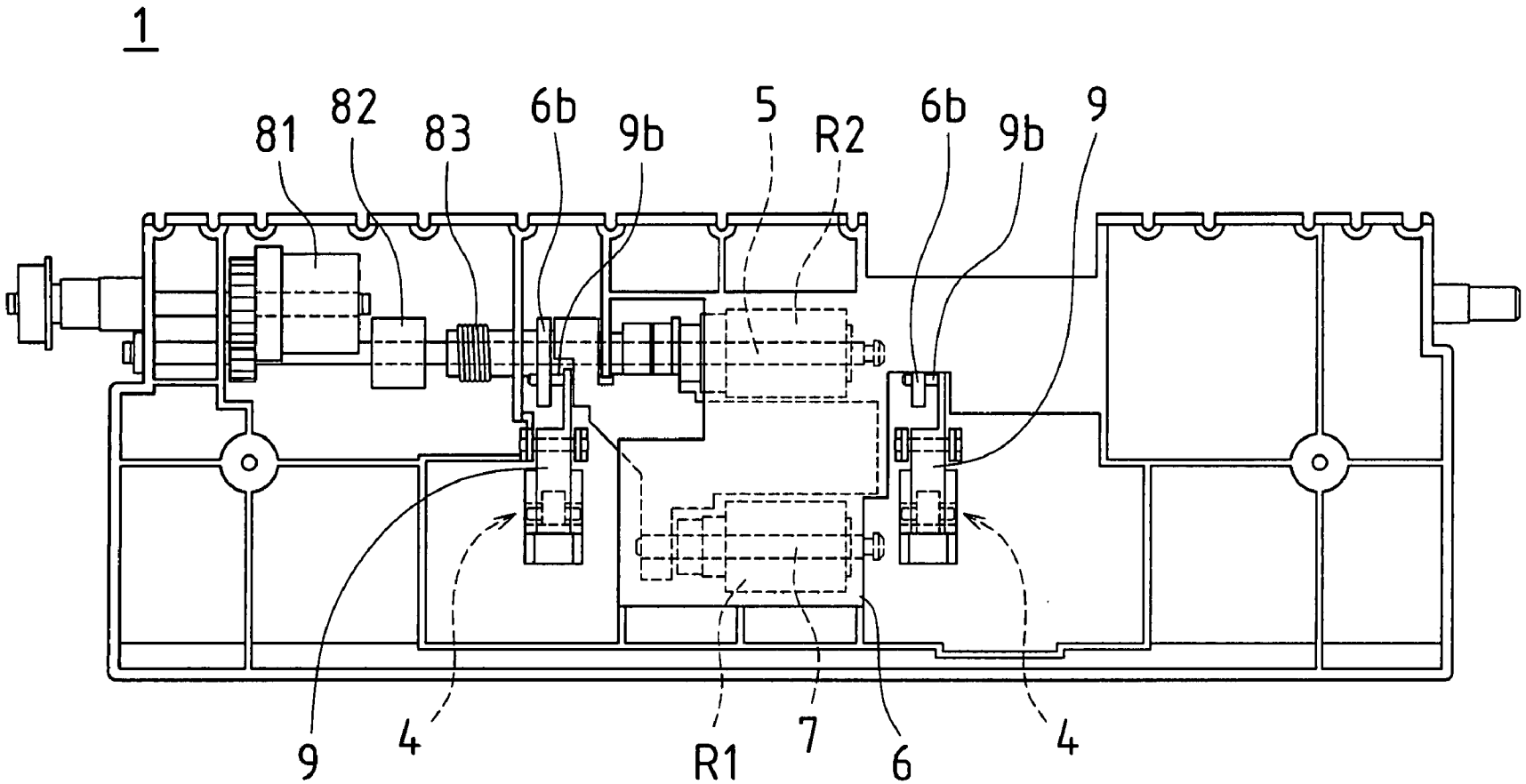
FIG. 25 is a schematic plan view of a conventional original transport apparatus.

FIG. 20 is a flowchart showing operations during double-sided original capture at original capturing apparatus 101. Below, operations taking place during double-sided original capture are described with reference to this flowchart.

First, when double-sided image capture processing has been selected, a double-sided original is transported by pickup roller R1 for original supply (step S601), and as described above, the original is paused by drive roller R3 (step S602). Next, determination is made as to whether pivot plate 129 at intermediate tray 128 of the original discharge component is at its second position (step S603). The second position here refers to the orientation indicated by the dashed line in FIG. 18, this orientation being for guiding the original to intermediate tray 128 following image capture.

If the result of determination at step S603 is that pivot plate 129 is not at its second position, then pivot plate 129 is moved to its second position (step S624).

After the position of pivot plate 129 at intermediate tray 128 has thus been established, transport of the original is resumed in coordination with the timing of original capture (step S604).

Image information corresponding to the front side of the transported original is captured at the original capture component (step S605). At this time, captured image information corresponding to the front side of the original is input into controller memory (step S606). Here, the image information corresponding to the front side of the original which is stored in memory is subjected to image processing before being stored therein.

While such image processing and such storing in memory is being carried out, the original is transported by way of transport rollers R5, R6 to discharge rollers R7, R8, which are rotating in the original discharge direction; and because pivot plate 129 is in its second position, the original is guided to intermediate tray 128 (step S607). After being guided to intermediate tray 128, transport of the original is paused with the trail edge in the original transport direction thereof held in the nip formed between discharge rollers R7, R8 (step S608).

This concludes description of the front-side capture transport process.

Thereafter, discharge rollers R7, R8 rotate in directions opposite to the directions of rotation at step S607, as a result of which the original is transported along auxiliary transport path 130 (step S609). The transported original is paused at drive roller R3 (step S610), transport of the original being resumed in coordination with the timing of original capture (step S611).

Image information corresponding to the back side of the transported original is captured at the original capture component (step S612). At this time, captured image information corresponding to the back side of the original is subjected to image processing at the controller and is thereafter sent to the laser generation component of the image forming component (step S613).

While such image processing and such sending of the original is being carried out, the original is again transported by way of transport rollers R5, R6 to discharge rollers R7, R8, which are rotating in the original discharge direction; and because pivot plate 129 is in its second position, the original is guided to intermediate tray 128 (step S614). After being guided to intermediate tray 128, transport of the original is paused with the trail edge in the original transport direction thereof held in the nip formed between discharge rollers R7, R8 (step S615).

This concludes description of the back-side capture transport process.

Thereafter, discharge rollers R7, R8 rotate in directions opposite to the directions of rotation at step S614, as a result of which the original which had been paused is now transported along auxiliary transport path 130 (step S616). As the original is transported in such fashion, determination is made by means of original insertion sensor 126 as to whether the trail edge of the original passing therethrough has passed by this original insertion sensor 126 (step S617). At this time, if the trail edge of the original has passed therethrough and if there is/are in addition subsequent original(s) ("Yes" as determined at step S618), the subsequent original is transported by pickup roller R1 for original supply (step S619), and the original is paused by drive roller R3 (step S620), in which state it awaits synchronization with original capture timing. In this way, subsequent original(s) is/are also transported, during which time the front and back thereof are captured, following which the original(s) is/are transported along the transport path.

When the original, as it is being transported in such fashion, passes original insertion sensor 126, determination is made as to whether pivot plate 129 is at its first position (step S621). At this time, since pivot plate 129 will have still been in its second position from when it was put in that orientation at step S603, it is moved to its first position (step S625).

The position of pivot plate 129 is thus established. During this period as well, the original is transported, being transported by way of transport rollers R5, R6 to discharge rollers R7, R8, the fact that these are rotating in the original discharge direction and the orientation of pivot plate 129 causing the original to be discharged onto original discharge tray 122 (step S623). Here, when it has been confirmed that the original passing therethrough, image capture having been completed with respect thereto, has passed through the original capture component (step S622), transport of the subsequent original, which had been paused by drive roller R3 and made to wait as described above, is resumed, and image capture is carried out with respect to this subsequent original.

This concludes description of the slewed original transport process.

The foregoing sorts of original transport operations and operations carried out by the original capture component permit double-sided original capture to be carried out.

In this way, three transport processes—these being "front-side original capture transport," "back-side original capture transport," and "slewed original transport"—are involved in carrying out double-sided original capture. With respect to the reason for carrying out such transport, it should of course be clear why "front-side original capture transport" and "back-side original capture transport" are necessary; and following conclusion of the "back-side original capture transport" process, when the position of pivot plate 129 is moved and original(s) is/are discharged into original discharge tray 122, in the event that there are a plurality of original sheets to be processed it will be the case that pages will be out of sequence and not in the same order as in the original document. The "slewed original transport" process is for remedying disadvantageous circumstances such as this.

As described above, in accordance with one or more embodiments of the original transport apparatus of the present invention, in the context of a constitution in which when outer casing member(s) is/are in closed state(s) and the apparatus is in original takeup standby state(s), engagement of stopper member(s) by engagement piece(s) causes stopper member(s) to be retained in state(s) in which stopper member(s) stop lead edge(s) of original(s) at prescribed location(s), constraining location(s) of lead edge(s) of original(s) and preventing entry of original(s) into transport path(s); and when outer casing member(s) is/are in closed state(s) and takeup of original(s) is proceeding, engagement piece(s) is/are displaced in pivoting fashion, disengaging engagement between engagement piece(s) and stopper member(s), permitting pivoting displacement of stopper member(s) and allowing transport of original(s), a structure is adopted such that one end of arm member(s) is supported by outer casing member(s) so as to permit displacement in pivoting fashion, and shaft(s) of stopper member(s) is/are secured to other end(s) of such arm member(s). That is, when outer casing(s) which had at least immediately prior thereto been in open state(s) is/are closed, because bottom region(s) of stopper member(s) abuts or abut and is/are pressed upward by original(s) loaded in original tray(s), causing other end(s) of arm member(s) to be displaced upward in pivoting fashion, in accompaniment to which stopper member(s) is/are lifted upward so as to be contained within outer casing member(s), it is possible to mitigate interference by stopper member(s) with respect to original(s) and it is possible to prevent damage to original(s). Furthermore, by providing arm member(s) with lifting piece(s) for lifting engagement piece(s) upward, it is possible to more definitively disengage engagement between stopper member(s) and engagement piece(s). Moreover, by providing outer casing member(s) with guide component(s) causing stopper member(s) to be displaced in pivoting fashion such that it/they is/are raised upward when arm member(s) is/are displaced in pivoting fashion such that it/they subtends or subtend not less than preestablished angle(s), damage to original(s) and/or stopper member(s) can be definitively prevented.

Furthermore, in accordance with one or more embodiments of the original transport apparatus of the present invention, in the context of a constitution in which when outer casing member(s) is/are in closed state(s) and the apparatus is in original takeup standby state(s), the fact that pickup roller(s) is/are positioned in upper region(s) within outer casing member(s) causes engagement between stopper member(s) and engagement piece(s) to be retained, constraining location(s) of lead edge(s) of original(s) and preventing entry of original(s) into transport path(s); and when outer casing member(s) is/are in closed state(s) and takeup of original(s) is proceeding, pickup arm(s) is/are displaced downward in pivoting fashion so as to cause pickup roller(s) to move downward and away from outer casing member(s) so as to not be hidden thereby, and in linked fashion with respect to this pivoting displacement, engagement piece(s) is/are displaced in pivoting fashion, disengaging engagement between engagement piece(s) and stopper member(s), permitting pivoting displacement of stopper member(s) and allowing transport of original(s), a structure is adopted such that pickup arm(s) have first standby position(s), at which such pickup arm(s) and engagement piece(s) are not engaged, but at which engagement piece(s) and stopper member(s) are engaged; and second standby position(s), between first standby position(s) and position(s) occupied when takeup of original(s) is proceeding and pickup roller(s) has or have moved downward and away from outer casing member(s) so as to not be hidden thereby, at which pickup arm(s) and engagement piece(s) are engaged, but at which engagement piece(s) and stopper member(s) are disengaged; retaining member(s) being provided at outer casing member(s); and retaining member(s) retaining pickup arm(s) when second standby position(s) is/are occupied. That is, when outer casing member(s) is/are closed, because, stopper member(s) not being bound, bottom region(s) thereof abut original(s) and bottom region(s) of stopper member(s) thereafter slide over original surface(s), so that lifting thereof proceeds as outer casing member(s) is/are closed, it is possible to mitigate interference by stopper member(s) with respect to original(s) and it is possible to prevent damage to original(s).

What is claimed is:

1. An original transport apparatus automatically taking up one or more originals one sheet at a time from a loading tray and transporting said sheet toward a transport path, said apparatus comprising:

a tray for loading said originals, the tray being inclined downward and having a lower tip region;

an outer casing member arranged above said lower tip region;

a first shaft positioned perpendicular to a direction of sheet transport;

said outer casing member disposed so as to permit opening and closing about said first shaft;

a stopper member positioned in the lower tip region of the tray against which the originals can abut and align prior to transport;

an engagement piece disposed in the outer casing member on a second shaft positioned perpendicular to the direction of sheet transport so as to permit independent pivotal displacement thereof;

the stopper member being positioned on a third shaft, which is positioned perpendicular to the direction of sheet transport, so as to permit pivotal displacement thereof, the stopper member causing a lead edge of said sheet to stop at a prescribed location;

said engagement piece being capable of engaging with the stopper member; and a lifting member supported by the outer casing member and attached to the stopper member to permit the stopper member to move vertically in the outer casing member when abutting a sheet;

the lifting member having an arm member located and pivotally supported at a first end within the outer casing member;

said third shaft located at a second end of the arm member, to which the stopper member is pivotally secured;

wherein, when the outer casing member is closed and the apparatus is in an original takeup standby state, engagement of the stopper member by the engagement piece causes the stopper member to be retained in a position in which the stopper member stops the lead edge of the sheet at the prescribed location, thereby constraining the lead edge at the prescribed location and preventing entry of the sheet into the transport path;

wherein, when the outer casing member is closed and takeup of the sheet is proceeding, the engagement piece is displaced in pivoting fashion, thereby disengaging engagement between the engagement piece and the stopper member, permitting pivoting displacement of the stopper member and allowing transport of the sheet.

2. An original transport apparatus according to claim 1 wherein:

during the course of closing the outer casing member from an open state, the stopper member which is engaged with the engagement piece abuts and is pressed upward by the sheet in the tray, thereby causing the second end of the arm member to be displaced upward in pivoting fashion about the first end, in accompaniment to which the stopper member moves upward within the outer casing member.

3. An original transport apparatus according to claim 1, further comprising a lifting piece integrally connected to the arm member for lifting the engagement piece upward;

wherein, when closing the outer casing member from the open state, the stopper member which is engaged with the engagement piece abuts and is pressed upward by the sheet in the tray, thereby causing the second end of the arm member to be displaced upward in pivoting fashion around the first end, in accompaniment to which the stopper member moves upward, and the lifting piece moves upward so as to further lift upward the engagement piece and thereby disengage engagement between the stopper member and the engagement piece.

4. An original transport apparatus according to claim 2 or 3 wherein the outer casing member is provided with a guide component causing the stopper member to be displaced in pivoting fashion such that it is raised upward when the arm member is displaced in pivoting fashion such that it subtends not less than a preestablished angle.

5. An original transport apparatus according to claim 2 or 3 wherein the outer casing member is provided with a guide component causing the stopper member to be displaced in pivoting fashion such that it is raised upward when the arm member is displaced in pivoting fashion such that it subtends not less than a preestablished angle;

the guide component comprises a guide surface formed at a top inside wall region of the outer casing member; and the stopper member has a top region which, when moved upward abuts the guide surface and slides therealong so as to cause the stopper member to be displaced in pivoting fashion such that it is raised upward.

6. An original transport apparatus automatically taking up one or more originals one sheet at a time from a loading tray and transporting said sheet toward a transport path, said apparatus comprising:

a tray for loading said originals, the tray being inclined downward and having a lower tip region;

an outer casing member arranged above said lower tip region;

a first shaft positioned perpendicular to a direction of sheet transport;

said outer casing member disposed so as to permit opening and closing about said first shaft;

a stopper member positioned in the lower tip region of the tray against which the originals can abut and align prior to transport;

an engagement piece disposed in the outer casing member on a second shaft positioned perpendicular to the direction of sheet transport so as to permit independent pivotal displacement thereof;

the stopper member being positioned on a third shaft, which is positioned perpendicular to the direction of sheet transport, so as to permit pivotal displacement thereof, the stopper member causing a lead edge of said sheet to stop at a prescribed location;

the engagement piece being capable of engaging with the stopper member;

a pickup arm disposed in the outer casing member so as to permit displacement in pivoting fashion about an axis located in a direction perpendicular to the sheet transport direction;

said pickup arm having two ends, a pickup roller for taking up said sheet from the tray being positioned at one end and a thrust member at the other end for engaging the engagement piece; and a lifting member supported by the outer casing member and attached to the stopper member to permit the stopper member to move vertically in the outer casing member when abutting a sheet;

the lifting member having an arm member located and pivotally supported at a first end within the outer casing member;

said third shaft located at a second end of the arm member, to which the stopper member is pivotally secured;

wherein, when the outer casing member is closed and the apparatus is in an original takeup standby state, the fact that the pickup roller is positioned in an upper region within the outer casing member, thereby preventing engagement of the thrust member with the engagement piece, causes engagement to be retained between the stopper member and the engagement piece, constraining a location of the lead edge of said sheet and preventing entry of said sheet into the transport path; and wherein, when the outer casing member is closed and takeup of said sheet is proceeding, the pickup arm is displaced downward to cause the pickup roller to move downward and away from the outer casing member so as to not be hidden thereby, and linked with the downward displacement of the pickup arm causing engagement of the thrust member with the engagement piece, the engagement piece is displaced in pivoting fashion, thereby disengaging engagement between the engagement piece and the stopper member, permitting pivoting displacement of the stopper member and allowing transport of said sheet.

7. An original transport apparatus according to claim 6 wherein the pickup arm has:

a first standby position, at which the pickup arm and the engagement piece are not engaged, but at which the engagement piece and the stopper member are engaged; and a second standby position, between the first standby position and a position occupied when takeup of an original is proceeding and the pickup roller has moved downward and away from the outer casing member so as to not be hidden thereby, at which of the pickup arm and the engagement piece are engaged, but at which the engagement piece and the stopper member are disengaged;

a retaining member being provided at the outer casing member; and the retaining member retaining the pickup arm when the second standby position is occupied.

8. An original transport apparatus according to claim 7 wherein the retaining member comprises an elastically deformable plate spring provided at an inside wall of the outer casing member;

the pickup arm having a pivot tip region;

the retaining member abutting the pivot tip region of the pickup arm, retaining the pickup arm, when the pickup arm is displaced in pivoting fashion at least as far as the second standby position.

9. An original transport apparatus according to claim 7 wherein the retaining member comprises a pivot projection provided at a basal side, about which pivoting occurs of the pickup roller, and a pivot constraining rod constraining pivoting of the pivot projection;

the pivot projection abutting the pivot constraining rod, retaining the pickup arm when the pickup arm is displaced in pivoting fashion at least as far as the second standby position.

10. An original transport apparatus according to claim 7 further comprising:

a drive control means driving the pickup arm so as to displace it in pivoting fashion;

the drive control means for driving the pickup arm so as to cause it to be displaced in pivoting fashion from the first standby position to the second standby position when the outer casing member, which had at least immediately prior thereto been in a closed state, is opened.

* * * * *